US008955723B2

(12) United States Patent
Minica et al.

(10) Patent No.: US 8,955,723 B2
(45) Date of Patent: Feb. 17, 2015

(54) MULTI-HANDLE BEVERAGE DISPENSING VALVE

(71) Applicant: Schroeder Industries, Inc., San Antonio, TX (US)

(72) Inventors: Jason Minica, Schertz, TX (US); David Santy, Converse, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 0 days.

(21) Appl. No.: 13/799,299

(22) Filed: Mar. 13, 2013

(65) Prior Publication Data

US 2013/0256343 A1 Oct. 3, 2013

Related U.S. Application Data

(60) Provisional application No. 61/616,716, filed on Mar. 28, 2012, provisional application No. 61/635,050, filed on Apr. 18, 2012.

(51) Int. Cl.

| | |
|---|---|
| ***B67D 3/00*** | (2006.01) |
| ***B67D 1/00*** | (2006.01) |
| *B67D 1/14* | (2006.01) |

(52) U.S. Cl.

CPC ..... *B67D 1/0082* (2013.01); *B67D 1/0083* (2013.01); *B67D 1/1466* (2013.01); *B67D 1/0044* (2013.01)

USPC ..... 222/505; 222/129.1; 222/572; 222/559; 222/144.5; 222/506; 222/509; 222/511; 222/518

(58) Field of Classification Search

CPC .. B67D 1/0044; B67D 1/0083; B67D 1/0082; B67D 7/50; B67D 1/1477

USPC ..... 222/505, 129.1, 145.7, 145.8, 287, 222/402.1, 402.15, 466, 506, 516–518, 572, 222/573, 628, 631, 391, 192, 144.5, 511, 222/559; 251/233, 235, 236, 82; 220/772; 141/360; 137/607; 99/323.3, 366, 527

See application file for complete search history.

(56) References Cited

U.S. PATENT DOCUMENTS

| | | | | | |
|---|---|---|---|---|---|
| 2,766,772 | A * | 10/1956 | Welty et al. | ..... | 137/630.2 |
| 3,455,332 | A * | 7/1969 | Cornelius | ..... | 366/167.1 |
| 4,928,856 | A * | 5/1990 | White | ..... | 222/174 |
| 5,305,924 | A * | 4/1994 | Groover et al. | ..... | 222/129.1 |
| 6,598,763 | B2 * | 7/2003 | Van Der Meer et al. | ..... | 222/94 |
| 7,832,598 | B2 * | 11/2010 | Rode et al. | ..... | 222/413 |
| 2009/0065529 | A1 * | 3/2009 | Guadalupi | ..... | 222/129.1 |
| 2011/0107918 | A1 * | 5/2011 | Santy et al. | ..... | 99/275 |

FOREIGN PATENT DOCUMENTS

| | | | | |
|---|---|---|---|---|
| GB | 786191 | * 11/1957 | ..... | B67D 1/0083 |

* cited by examiner

*Primary Examiner* — Frederick C Nicolas
*Assistant Examiner* — Bob Zadeh
(74) *Attorney, Agent, or Firm* — Jackson Walker, LLP

(57) ABSTRACT

Applicants' invention may retrofit or may be provided initially with a dispensing valve and comprises a second handle, interacting with a valve and/or a valve first handle for dispensing a beverage from the valve. Applicants' invention comprises a valve body typically having at least a pair of handles, one typically upstanding and one downwardly depending both which separately may be moved to actuate the dispensing mechanism within the valve to dispense a beverage therefrom.

21 Claims, 26 Drawing Sheets

MULTI-HANDLE BEVERAGE DISPENSING VALVE

This application claims the benefit of and incorporates herein by reference U.S. Provisional Application Ser. No. 61/616,716, filed Mar. 28, 2012, and U.S. Provisional Patent Application Ser. No. 61/635,050 filed Apr. 18, 2012, and incorporates by reference U.S. application Ser. No. 12/693,916, filed Jan. 26, 2010 (Publication No. US 2010/0187258).

FIELD OF THE INVENTION

Beverage dispensing valves, more specifically, a handle for manually dispensing a beverage from a valve.

BACKGROUND OF THE INVENTION

Beverages may be manually dispensed from a valve by moving a handle portion of the valve. For example, post-mix valves deliver a first and second fluid, typically soda water and a concentrate, such as a syrup, to a dispensing valve nozzle when actuated by a manual handle. A manual handle physically moves elements, which in turn open channels, allowing each of the two liquids to mix, for example, to mix within the nozzle on the valve body.

Some typical handles engage valve bodies in a vertically upstanding manner and the removed end of the handle may be grasped and pivoted about the near end, which pivot action lifts or otherwise moves a pair of members, the first and second members engaging the at least two fluid channels for mixing a first and second fluid to create a tasty beverage.

SUMMARY OF THE INVENTION

Applicants' invention may retrofit or may be provided initially with a dispensing valve and typically comprises a second handle, interacting with a valve and/or the first handle for dispensing a beverage from the valve. Applicants' invention comprises a valve body typically having at least a pair of handles, one typically upstanding and one downwardly depending both which separately may be moved to actuate the dispensing mechanism within the valve to dispense a beverage therefrom.

In one embodiment, Applicants retrofit a second depending handle to a valve housing an first handle. In a second embodiment, the two handles are integral.

In one embodiment, the second handle is not used but a vertical handle includes a grasping member tilted forward towards the user.

BRIEF DESCRIPTION OF THE DRAWINGS

FIG. 10C illustrates a right-side elevational view of the embodiment of FIGS. 10A and 10B, except without a second, depending handle.

DETAILED DESCRIPTION OF PREFERRED EMBODIMENT

Figure 3:
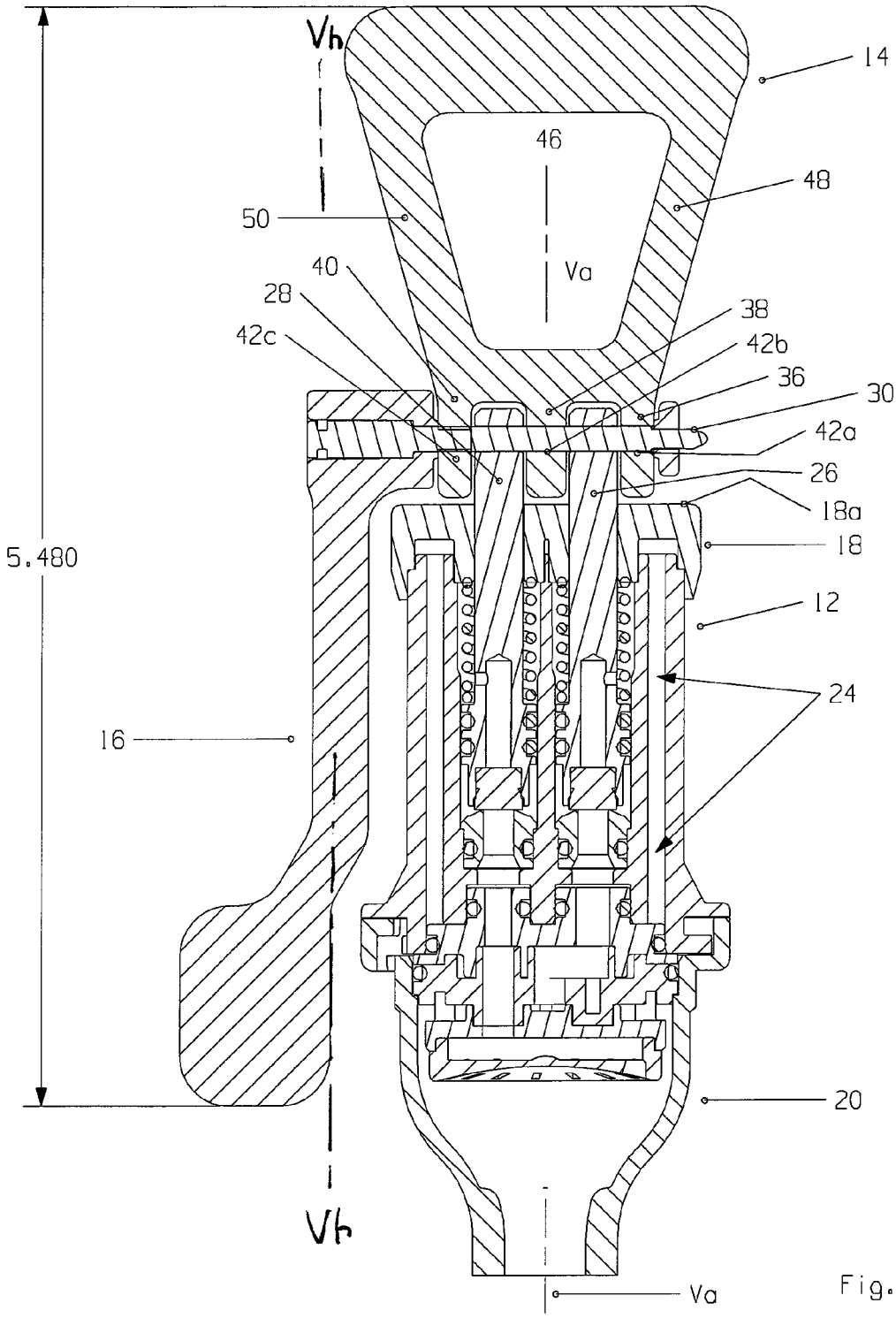
FIG. 3 is a cross-sectional view of a multi-handle beverage dispensing valve.
Figure 4:
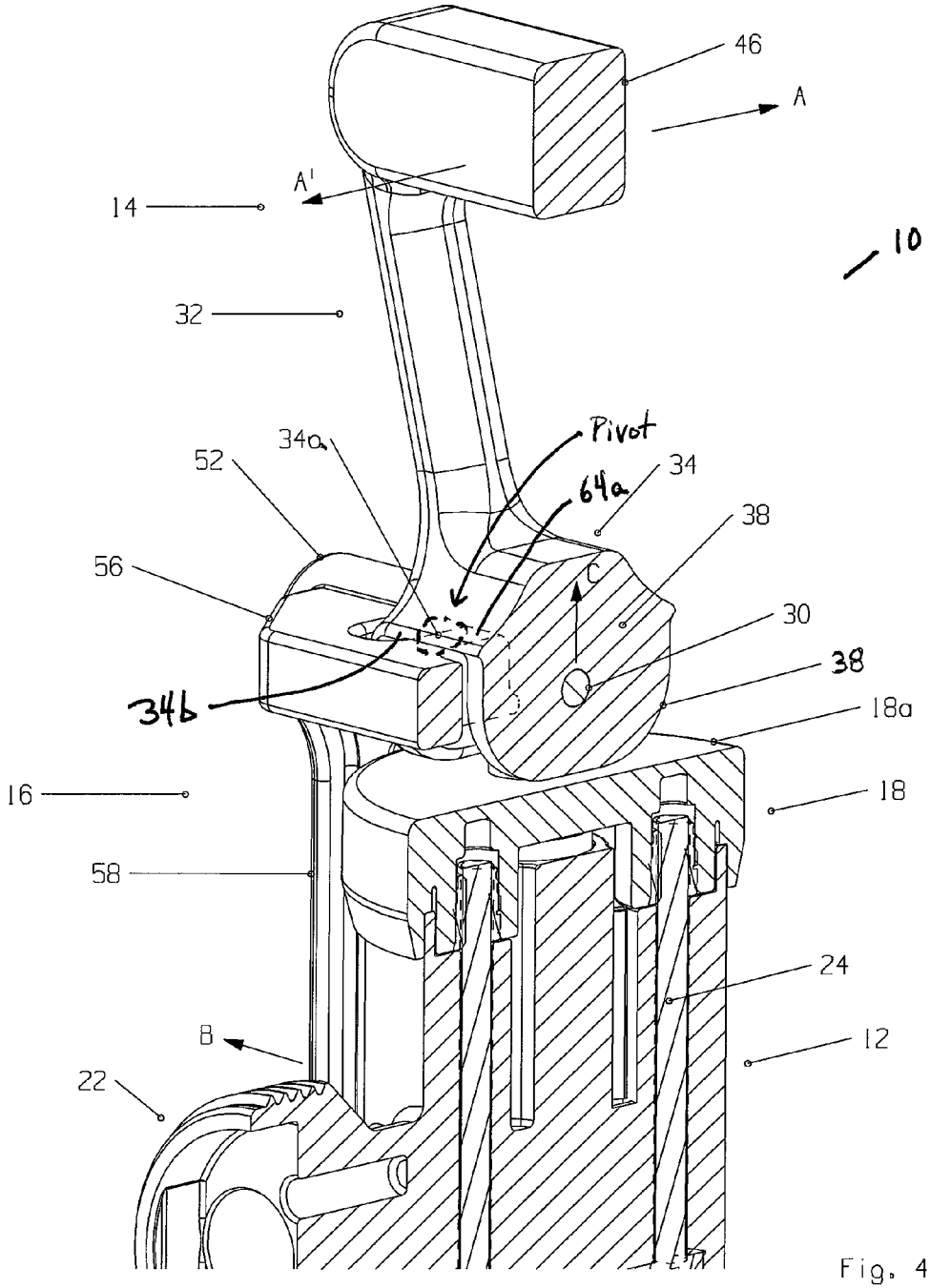
FIG. 4 is a side elevational view of the cross-sectional view of FIG. 3.
Figure 5:
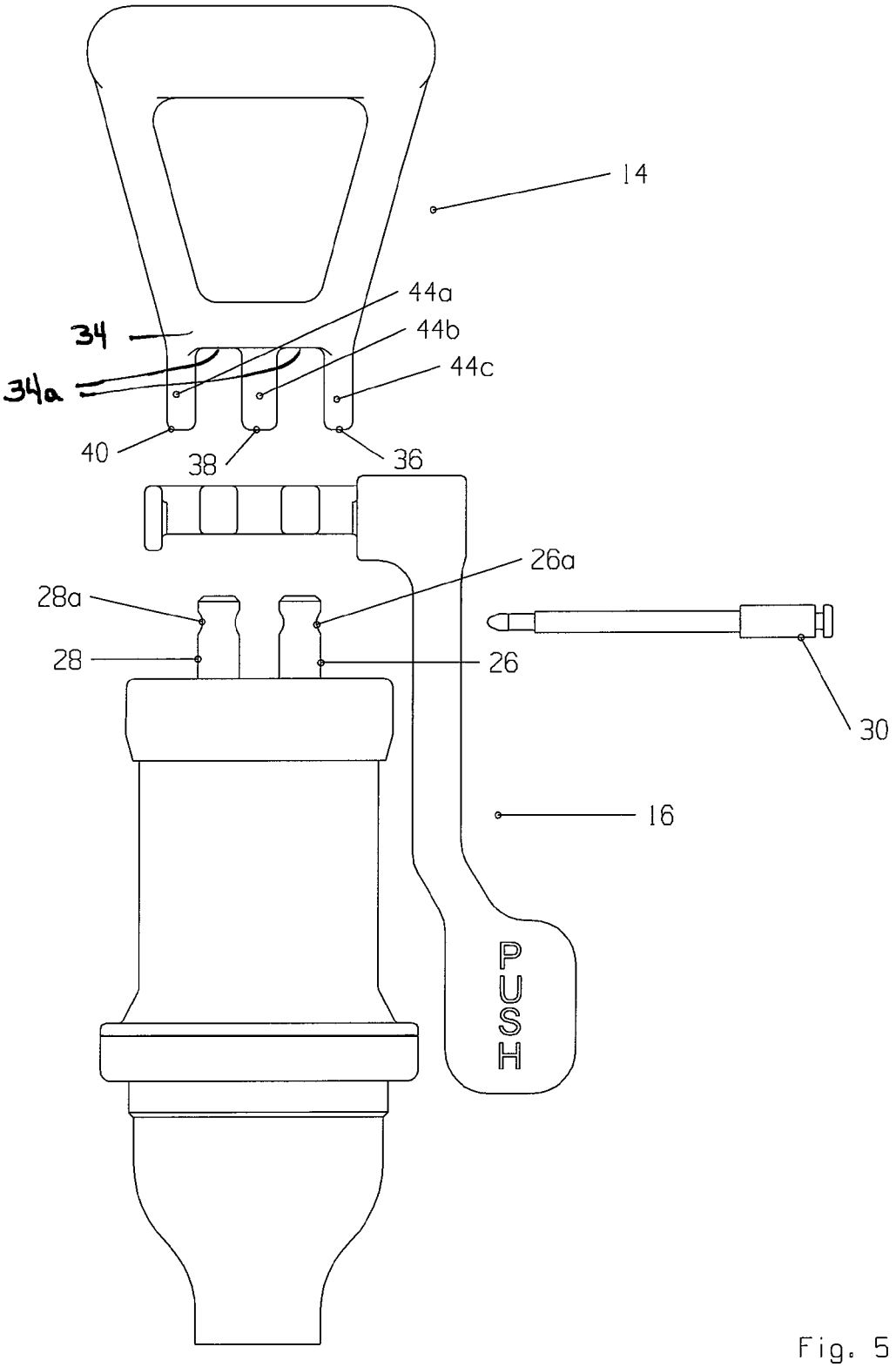
FIG. 5 is an exploded front elevational view of a multi-handle beverage dispensing valve.

FIGS. 1-5, 9 and 10A illustrate a multi-handle beverage dispensing valve 10. Beverage dispensing valve 10 may include a valve body 12. Valve body 12 may have a cap 18 on a proximate end of the body. Cap 18 may have a tabular or flat horizontal top surface 18*a*. A nozzle 20 may be located at the removed end of valve body 12. A first handle 14 is disclosed and may be direct acting as more specifically set forth below. A second, depending handle 16 directed downward may, in one embodiment, be indirect acting as set forth in more detail below. The valve body is seen to have a longitudinal or vertical axis Va. The second, depending handle may have a vertical axis Vh. In one embodiment, the vertical axis Vh lays parallel to Va, spaced apart and to the side of the valve body as seen in FIG. 5.

Figure 10A:
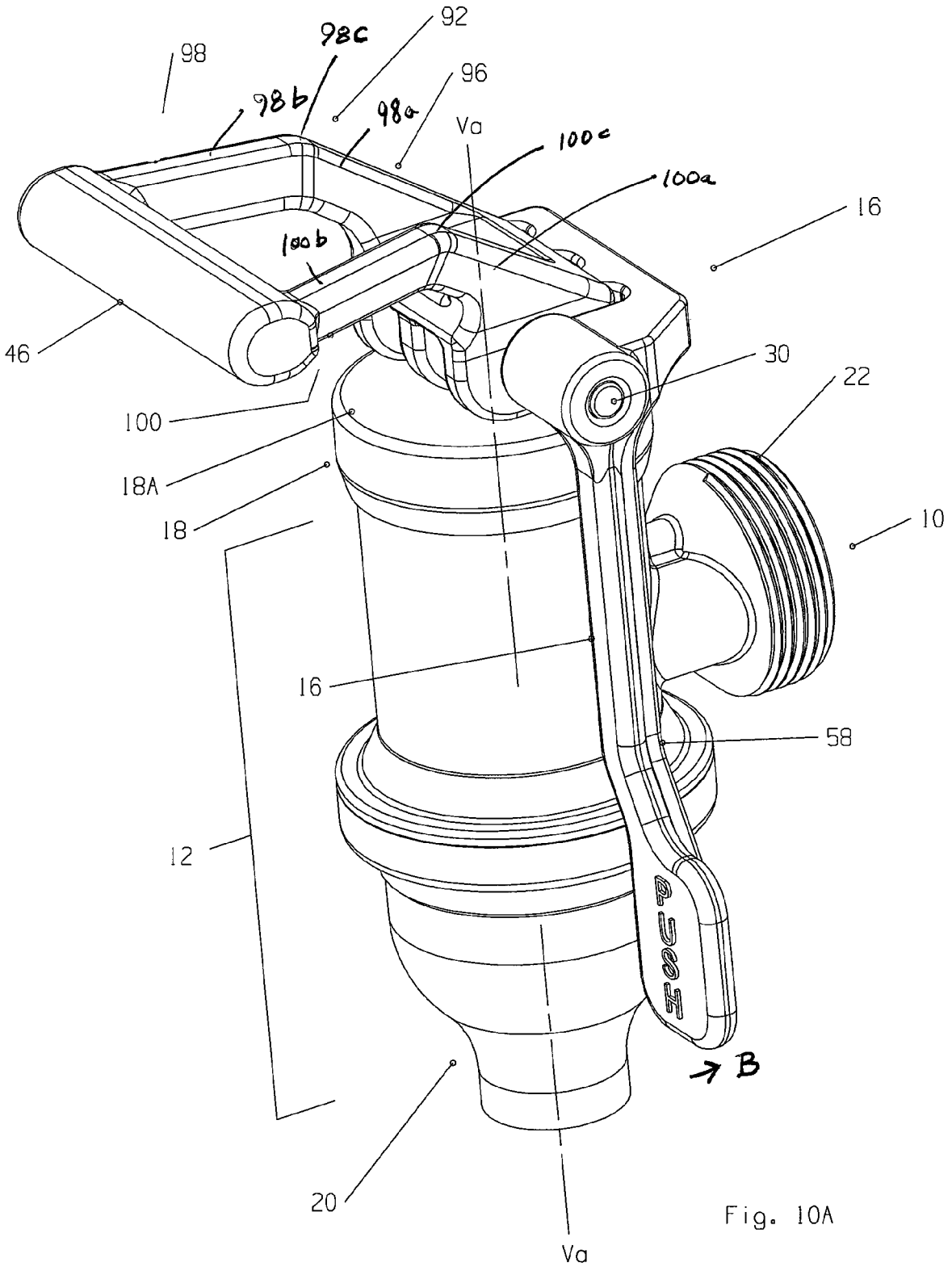
FIGS. 10A, 10B, and 10C illustrate perspective and right-side elevational views of a first embodiment of an angled handle multi-handle beverage dispensing valve.
Figure 10B:
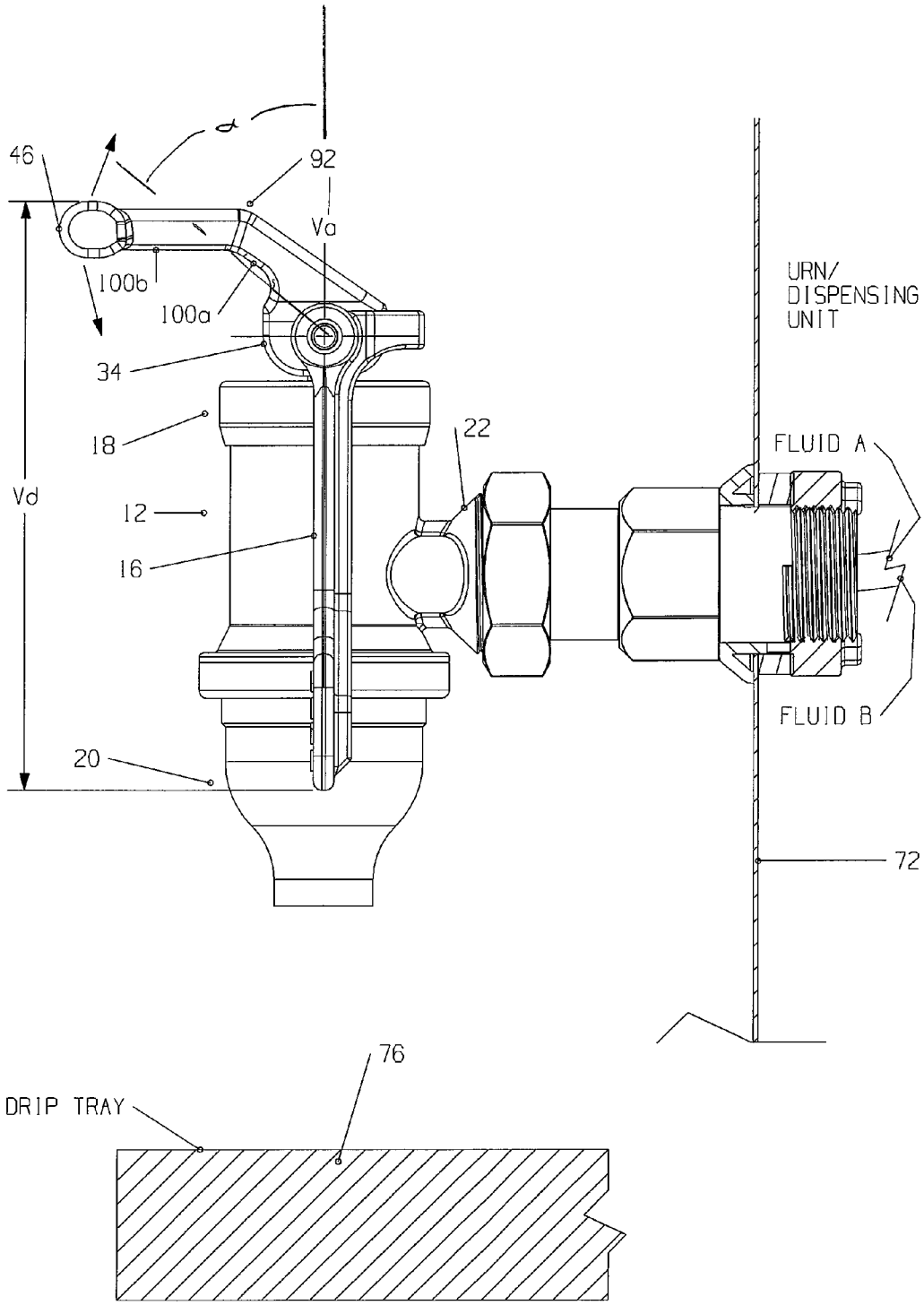
Figure 10C:
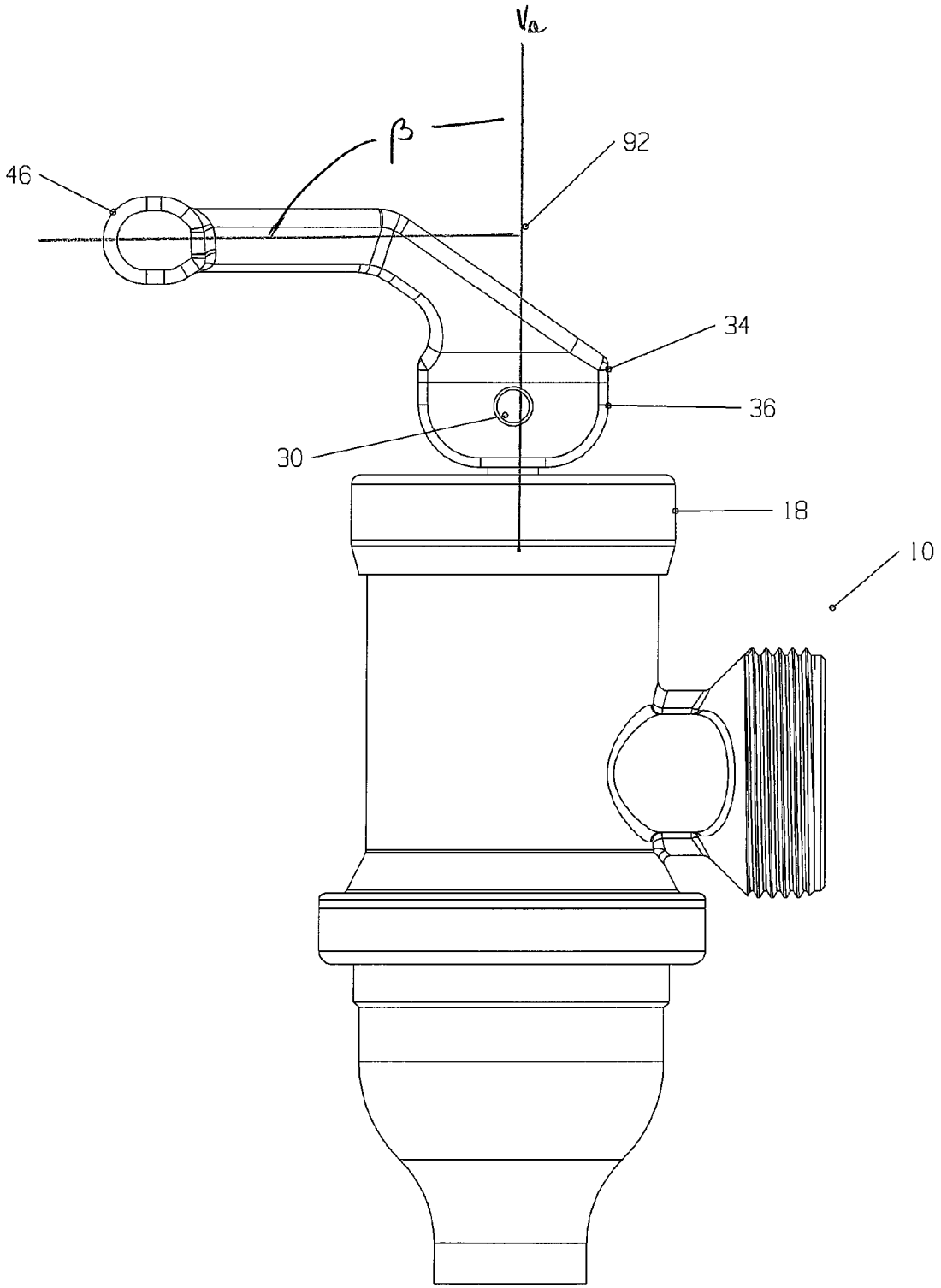
Figure 10D:
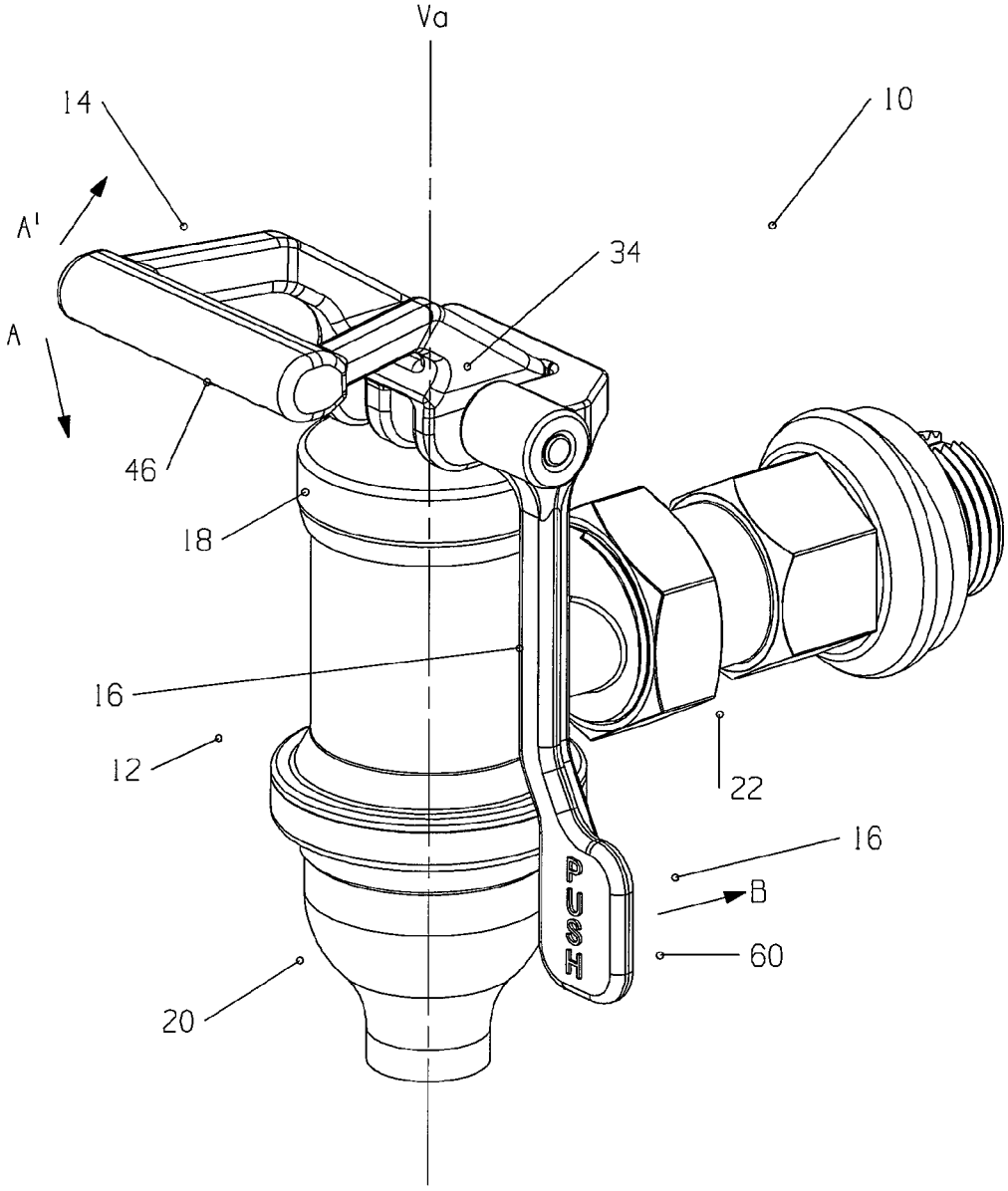
FIGS. 10D and 10E illustrate perspective views of the angled handle and a valve on an urn and base.
Figure 10E:
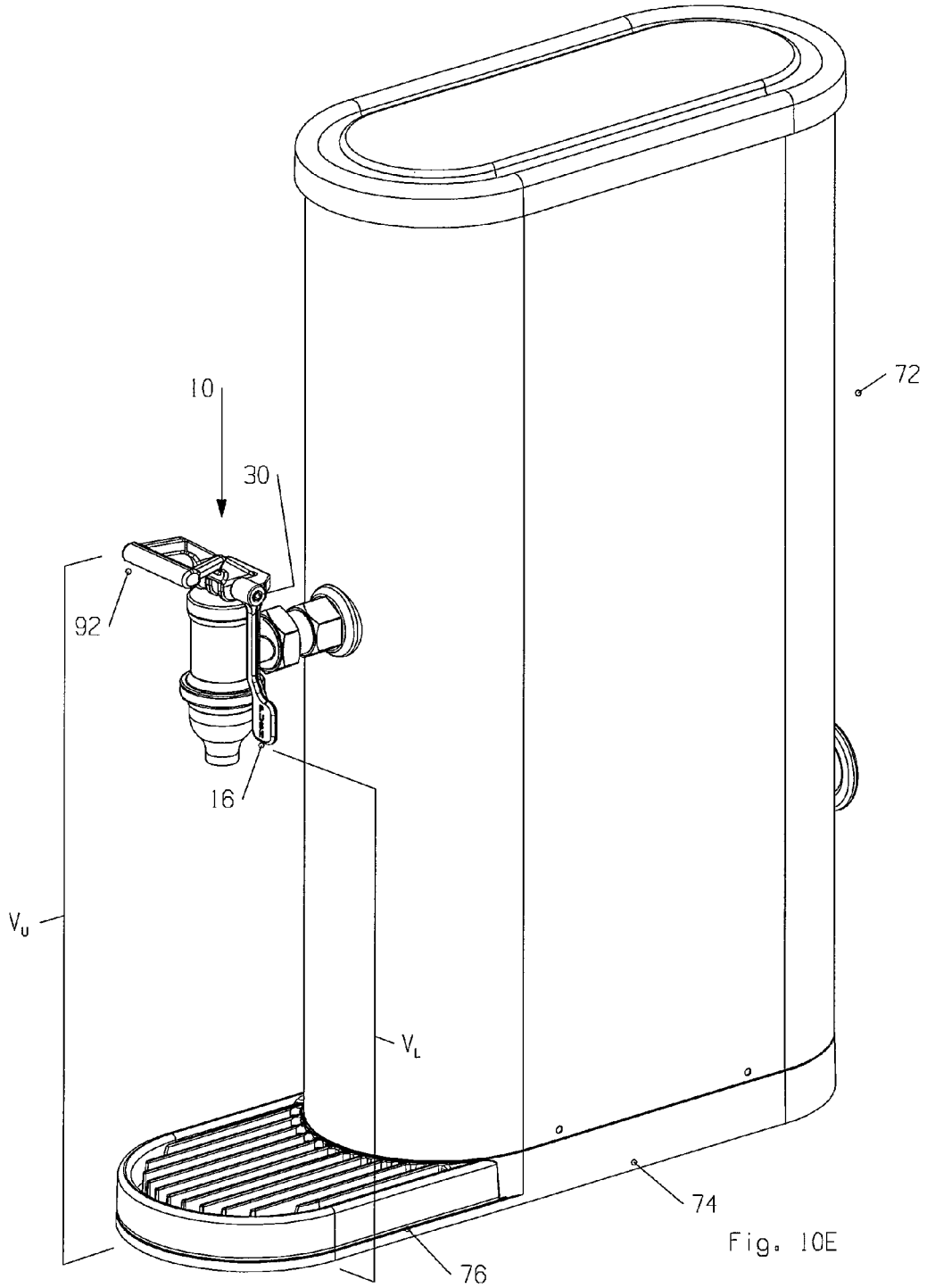

Connector or lateral member 22 typically engages a body of a dispensing apparatus which may include an urn 72 with a base 74, which may include a drip tray 76 (see FIG. 10E). One such dispensing apparatus provides pressurized bag-in-box concentrate or syrup and pressurized soda water (not shown) to the valve, for mixing in the valve nozzle in ways known in the art. Other dispensing apparatus may include a post-mix valve that combines plain water and a tea concentrate (sweetened or unsweetened, flavored or unflavored).

Typical valves, such as post-mix valves, include a dispense mechanism 24 within the valve body 12. Dispense mechanism 24 may have a pair of actuator arms 26/28 which, when lifted or otherwise moved as, for example, by moving a handle, will dispense a beverage from the valve into a container.

Turning back to handle 14, it is seen in one embodiment to have a yoke portion or yoke 32 and a base 34. Yoke 32 may comprise a cross-member 46 and two depending legs 48/50, legs 48/50 engaging base 34 of handle 14. The cross member is typically elongated horizontally and is configured to be grasped with the fingers. Cams, here three, 36/38/40 may depend downward from base 34 and yoke 32 may extend generally upward from base 34 when handle 14 is properly engaged to valve body 12. Handle 92, in FIGS. 10A and 12A may have a yoke 32*a* that displaces the yoke off axis and with the cross member generally perpendicular thereto. Turning back to FIGS. 3 and 5, an engagement pin 30 is disclosed, which engagement pin may engage both handle 14 and depending handle 16 as set forth herein.

[27] Cams 36/38/40 have pin receiving holes 42*a*/42*b*/42*c* aligned as set forth in FIG. 3 for receipt of pin 30 therethrough. Furthermore, the removed end of actuator arms 26/28 have holes 26*a*/28*a* therethrough, which holes 26*a*/28*a* are aligned with holes 42*a*/42*b*/42*c* for receipt of pin 30 therethrough. Thus, it can be seen if the removed end or yoke 32 of handle 14 is pivoted, it will lift actuator arms 26/28. Moreover, since actuator arms 26/28 are raised, a drink will dispense from the nozzle of the valve body. Handle 14 may have cam surfaces 44*a*/44*b*/44*c*, which cam surfaces cause a lifting of pin 30 when the removed end of yoke is rotated.

Turning to depending handle 16, it is seen to engage other elements of the valve body so that, while handle 14 is directed upward from the area of engagement pin 30 and actuator arms 26/28 or the area of top surface 18*a*, depending handle 16 depends downward such that there is a vertical space between the removed ends of handle 14 (upward) and the removed end of handle 16 (downward from valve body top) (FIG. 3 showing spacing of about 5.80").

Handle 16 is seen to comprise a pin engaging body 52 and has an arm 54 and a base 56. Pin engaging body 52 may be generally cylindrical or any other suitable shape and may comprise outer walls 52*a* and, in one embodiment, inner walls 52*b*. Pin engaging walls 52*c* may be part of pin engaging body 52. Pin engaging body 52 may be any appropriate shape, but typically includes pin engaging walls 52*c* and walls engaging arm 54. Arm 54 extends downward from pin engaging body 52 and may include an arm body 58, which typically defines a longitudinal axis vh generally aligned with vertical axis Va of valve body 12 and a tabular end portion 60. In one embodiment, tabular end portion 60 and arm body 58 may be separated by offset portion 58*a* as seen, for example, in FIG. 1 or 9. Handle 16 typically has base 56 configured to engage pin engagement body 52, such that when the removed end or tabular end portion 60 is moved and therefore when pin engaging body is rotated, base 56 will act to raise actuator arms 26/28. This is achieved, in one embodiment, with base 56 configured to engage, when rotated, an underside 34*a* of base 34 of handle 14. That is to say, pin engaging walls 52*c* engage body 52, which has an arm depending downward thereof and base 56 engaged therewith, such that rotation of handle 16 causes rotation of pin engaging body 52 about pin 30, which, in turn, will cause a portion of base 52 to interfere or contact the underside 34*a* of handle 14 causing it to pivot and lift pin 30.

Figure 2:
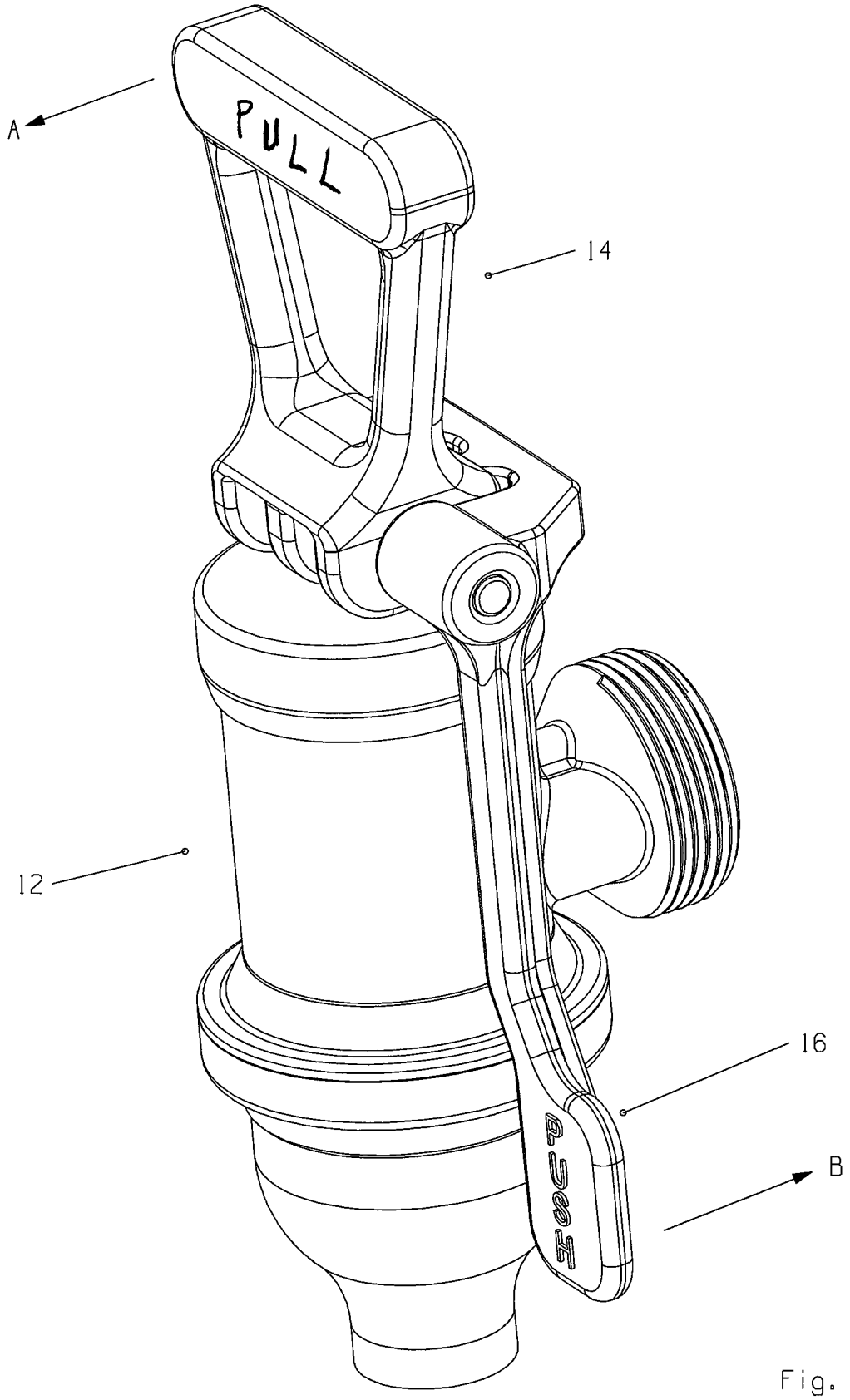
FIG. 2 is a right side, front upper elevational view of a multi-handle beverage dispensing valve.

A configuration of Applicants' multi-handle valve 10 may be seen in FIG. 4, wherein it is seen that pulling cross member 46 (or other portions of the yoke) of handle 14 in the direction indicated by Arrow A will cause pin 30 to lift and the valve to actuate. However, it is also seen that pushing on the end of body arm 58 will move the body arm and thus pin engaging body and base 56 in the direction indicated by Arrow B in FIGS. 4 and 10. This is also illustrated in FIG. 2 (see Arrows A and B, both generating the action described above, that is the lifting of the actuator arms and dispensing of the beverage from the valve. In the case of moving handle 14 in the direction of Arrow A, the lifting is accomplished by the action of cam surfaces 44*a*/44*b*/44*c* on top 18*a* of cap 18 in ways known in the art. In movement shown by Arrow B in FIGS. 2, 4, and 10 it is achieved by the top side of base 56 pivoting against underside 34*a*.

Figure 5B:
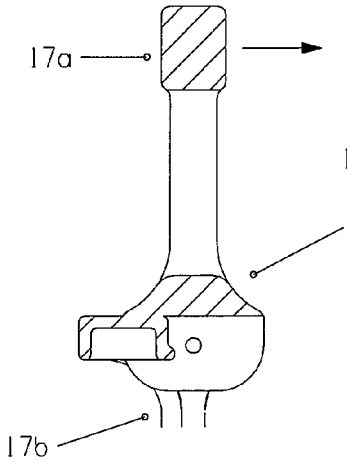
FIGS. 5A and 5B illustrate the unitized single piece handle in front elevational and side cross-sectional views.
Figure 5A:
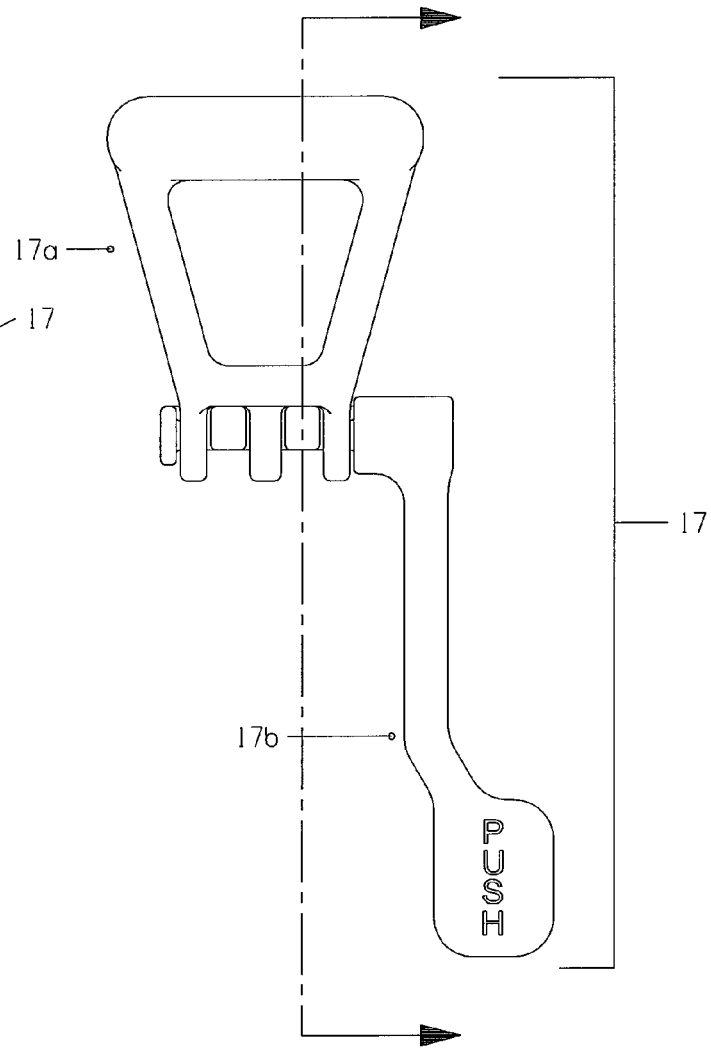

FIGS. 5A and 5B illustrate a one-piece unitized handle 17, which has the underside 34*a* of base 34 integral with the top side of base 56 of the second handle so they form essentially one unit. In such a case, movement of either a portion of unitized handle 17, that is upstanding portion 17*a* or depending portion 17*b*, in the directions indicated will cause dispensing of the fluid from the valve.

Figure 8:
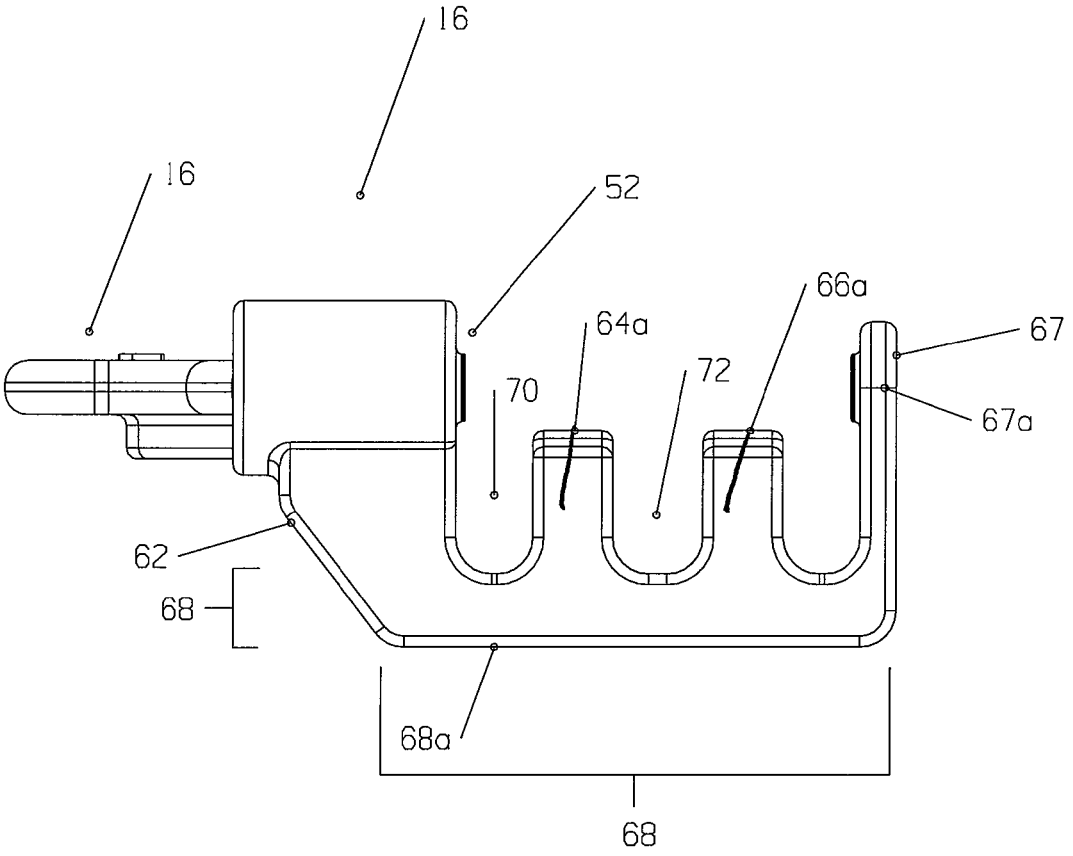
FIG. 8 is a top elevational view of the handle of FIGS. 1-5 and 6.

FIGS. 6-9 show additional views of Applicants' second or depending handle 16. Applicants' second or depending handle 16 is seen to include the pin engaging body 52 configured to receive engagement pin 30 therethrough and to typically lay adjacent base 34 of first or upstanding handle 14 or lay adjacent the base of handles 92/102 (see FIGS. 10A and 12B). It is seen, for example, with FIG. 8, that pin engaging body 52 may have a horizontal extension or interconnect member 62 extending generally perpendicular to the axis of arm body 58. Element 62 is intended to space apart a base member 68 that will trend generally parallel to engagement pin 30, but typically may be spaced rearward therefrom. Base 68 is generally tabular and has arms 64/66 extending therefrom (towards pin 30), which arms are separated by a bay 72, and between arm 64 and interconnect member 62, a bay 70. The function of arms and bay configuration is to allow the arms to reach beneath the rearward (trailing) edge 34*b* (see FIG. 4) of base 34, which arms have leading edges 64*a*/66*a* as seen in FIG. 8. FIG. 8 also illustrates a trailing edge 68*a* along the upper, rear surface of base 68. Upper surfaces 64*a*/66*a* provide, in conjunction with the rotational motion of handle 16, an upward pivot at "Pivot," FIG. 4 when the removed end of handle 16 is pushed. The leading edges of arms 64/66 typically are spaced rearward of pin 30 when the handle is in a rest (non-dispensing) position (see FIG. 4) and there is a gap below the bottom surfaces and top surface 18*a*.

Figure 1:
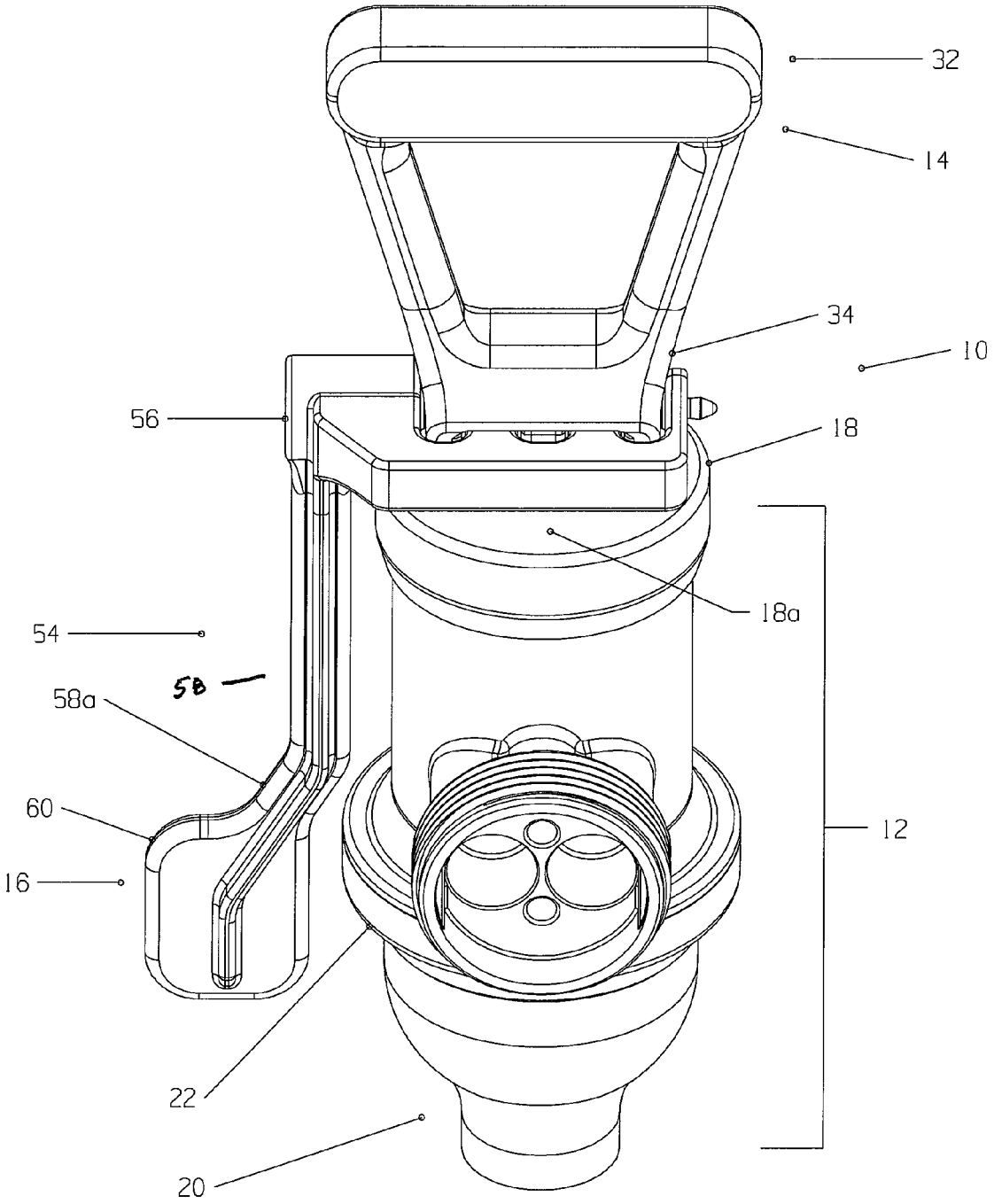
FIG. 1 is a perspective rear upper view of an embodiment of a multi-handle beverage dispensing valve.
Figure 6:
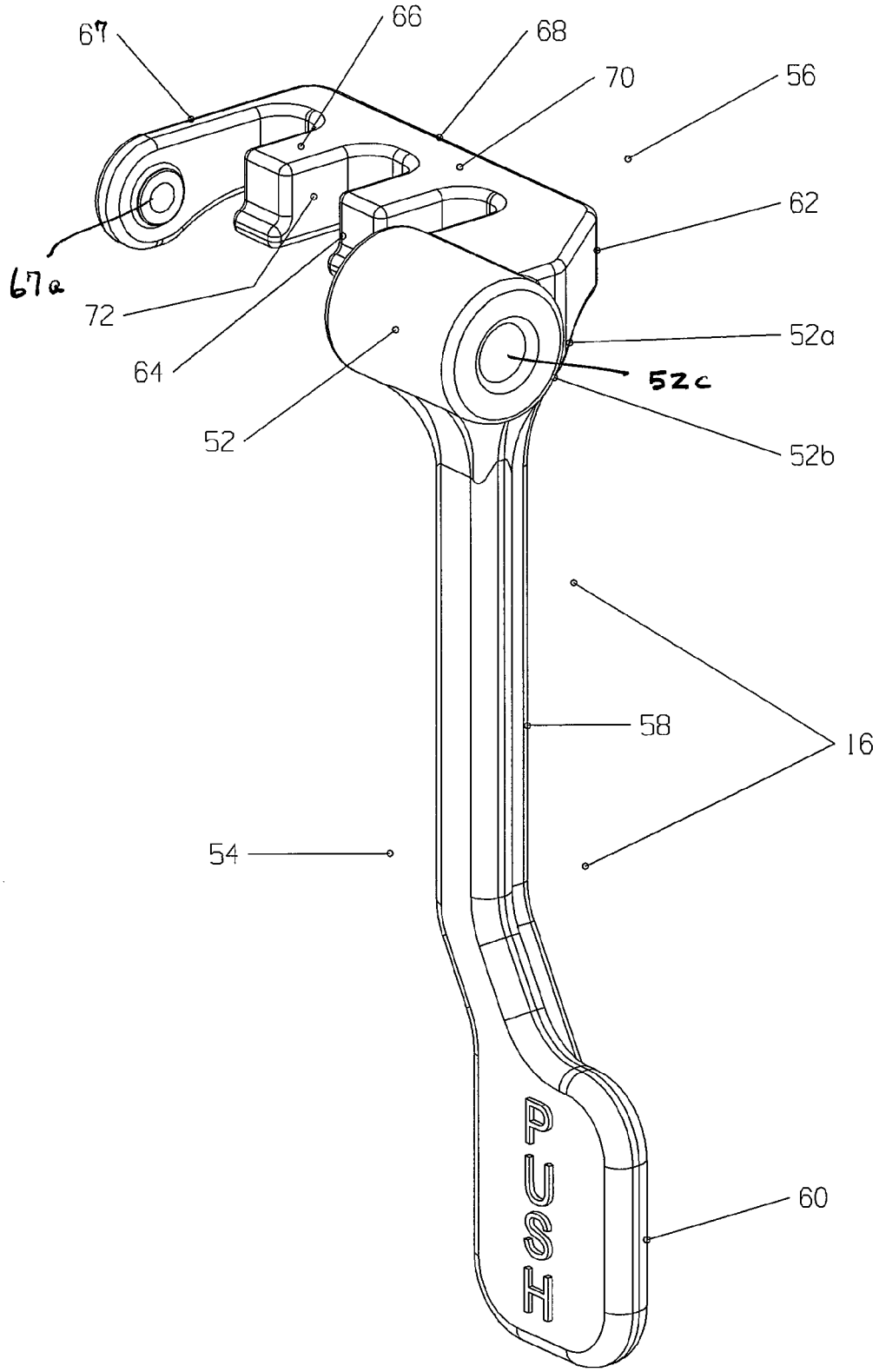
FIG. 6 is a front right side upper perspective view of a handle for use with Applicants' multi-handle beverage dispensing valve.
Figure 7:
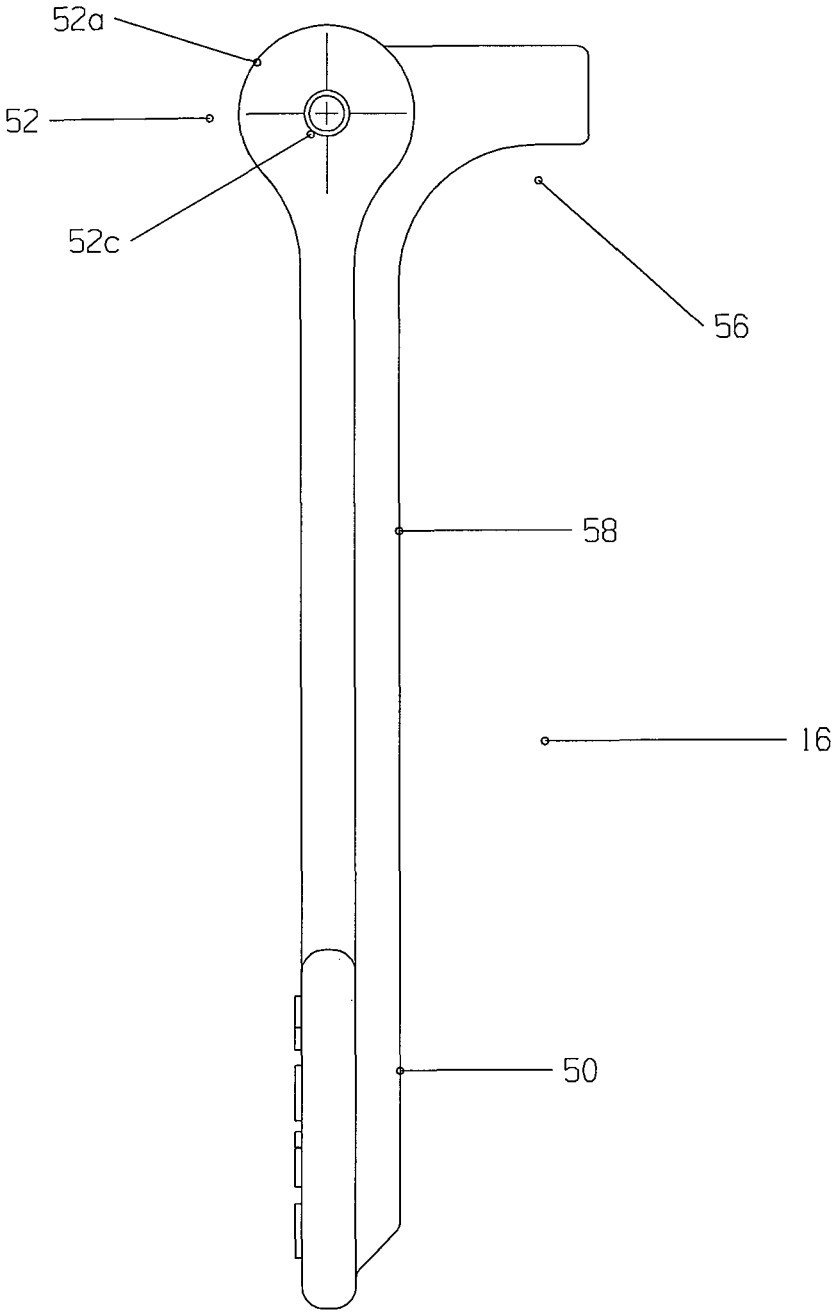
FIG. 7 is a right side elevational view of the handle of FIGS. 1-5 and 6.
Figure 9:
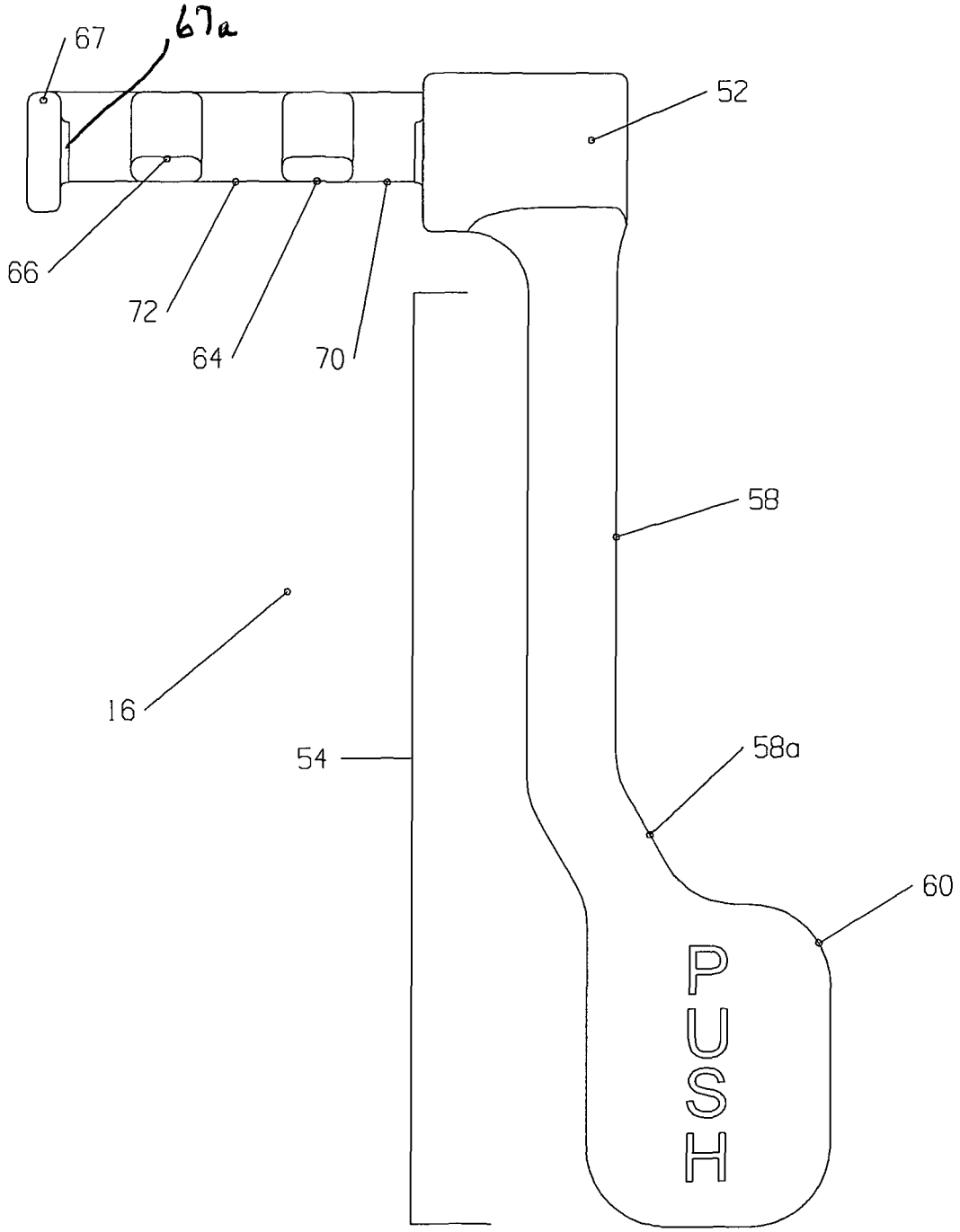
FIG. 9 is a rear elevational view of the handle of FIGS. 1-5 and 6.

By way of explanation on how two handles in FIGS. 1-5 operate, reference is made to FIGS. 1, 2, and 4. It will be seen that movement of handle 14 in direction A will cause cams 36/38/40 to interact with the top surface 18*a* and raise actuator arms 26/28 as pin 30 is raised. When this action occurs, handle 16, being entrained on the two removed ends of the actuator will simply raise slightly. When the removed end of handle 16 is pushed as indicated in FIG. 2, that is, towards the body of the dispenser, such as an urn, the action of arms 64/66 will act on the underside 34*a* of base 34 to pivot it in the direction illustration by A, while cams 36/38/40 act to raise the actuator arms. Thus, as either handle is pushed in the directions indicated by A (handle 14) or B (handle 16), the action is rotational about pin 30 as well as translational of pin 30 in the direction indicated by letter C in FIG. 4. FIGS. 6 and 9 illustrate arm 67, which has hole 67*a* aligned with pin engaging walls 52*c* of body 52. Thus, second depending handle 16 is firmly engaged with engagement pin 30. Likewise, first handle 14 is engaged with pin 30. Note, however, with the exception of FIGS. 5A and 5B, each handle moves separately, but in a coordinated manner when depending handle 16 is moved.

FIGS. 10A and 10B illustrate an additional (second) embodiment of Applicants' multi-handle dispensing valve. FIG. 10C illustrates a dispensing valve without Applicants' second, depending handle 16. FIG. 10C features only an angled handle 92 as more further set forth herein. FIGS. 11A-11D show the angled handle apart from the valve body. FIGS. 12A-F show a third embodiment, angled handle typically used without the depending handle.

Turning back to FIGS. 10A and 10B, it is seen that Applicants' angled handle 92 includes the base 34 substantially as set forth in earlier embodiments. Engaged with base 34 are a multiplicity of cams 36/38/40, again substantially similar to the earlier embodiments, the cams for engaging engagement pin 30.

Figure 11A:
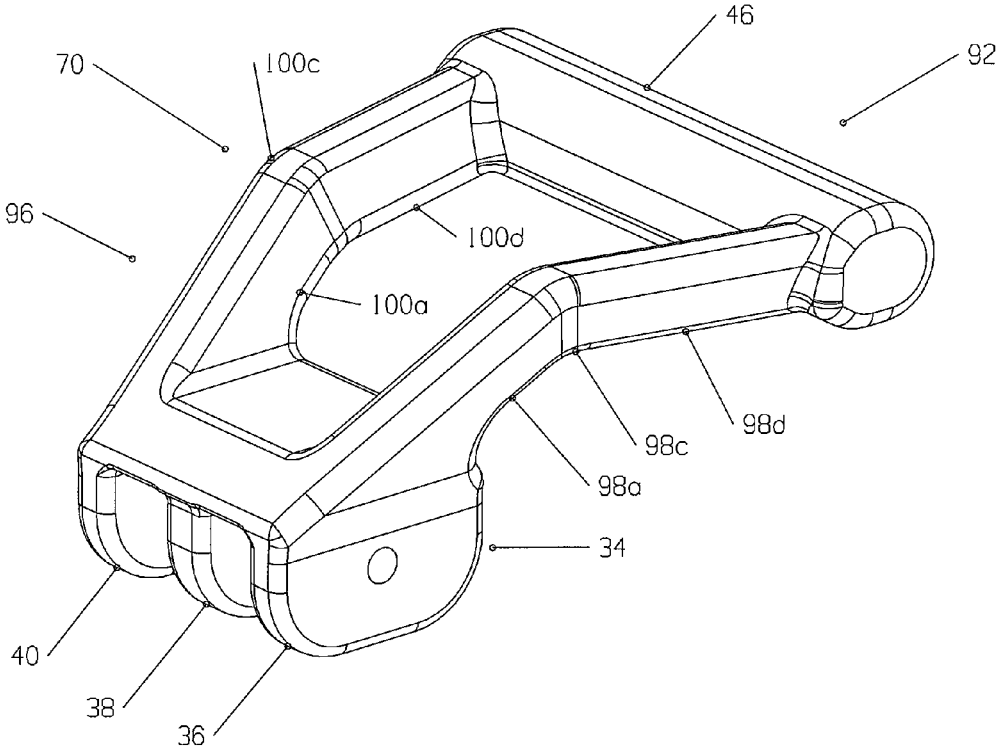
FIGS. 11A, 11B, 11C, and 11D illustrate the angled handle of FIGS. 10A, 10B, and 10C in perspective view, right-side elevational, bottom view and top view, respectively.
Figure 11B:
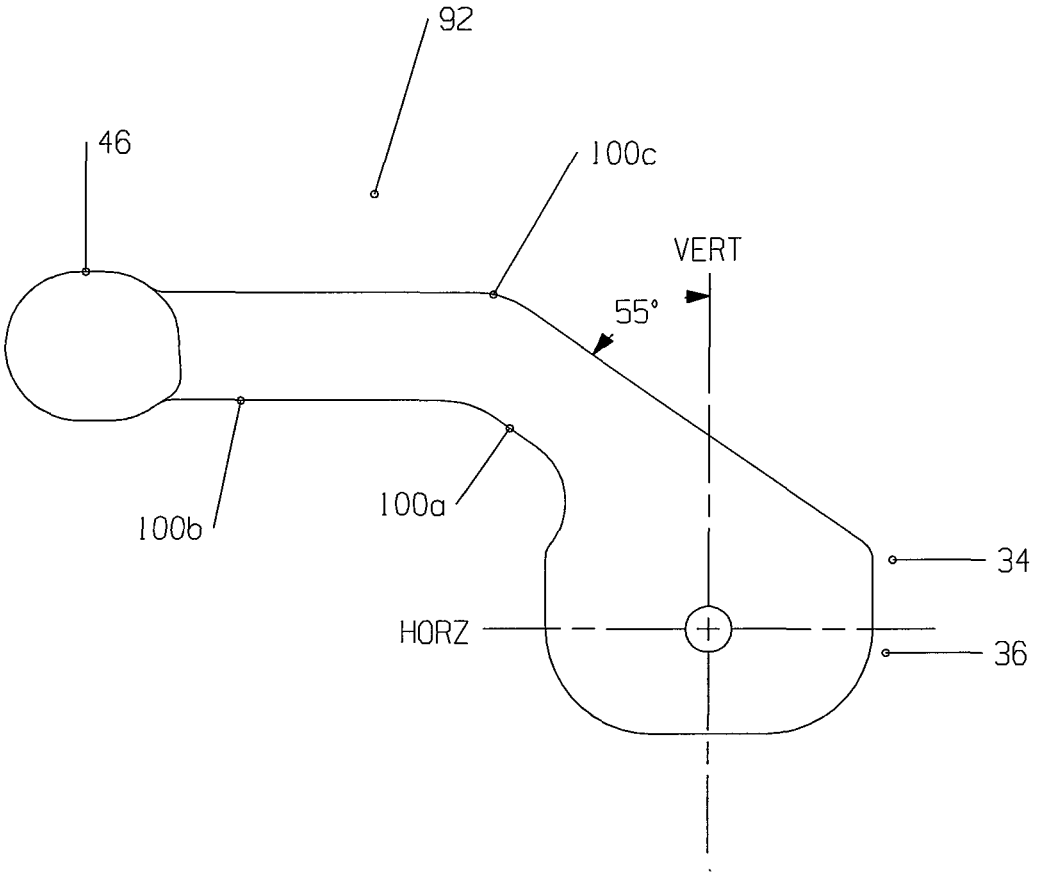
Figure 11C:
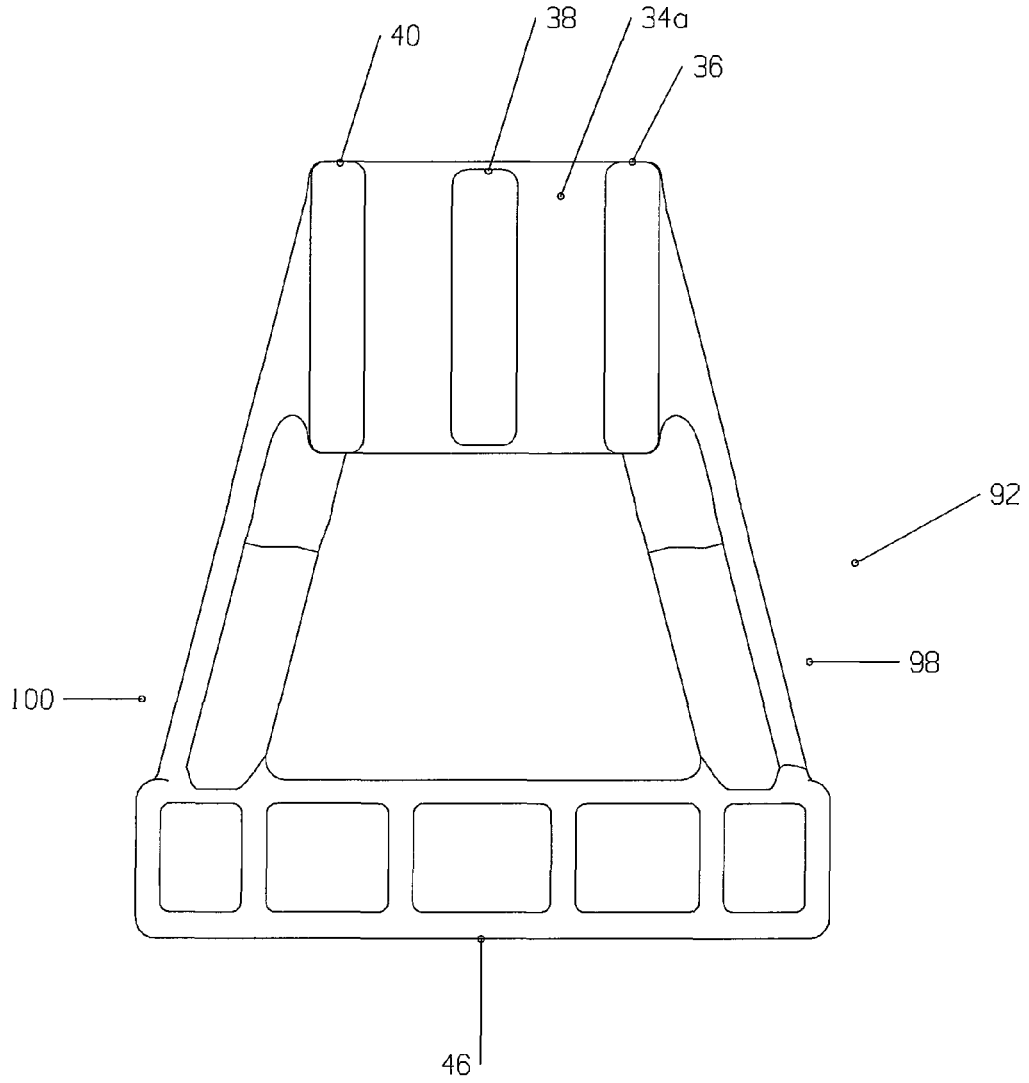
Figure 11D:
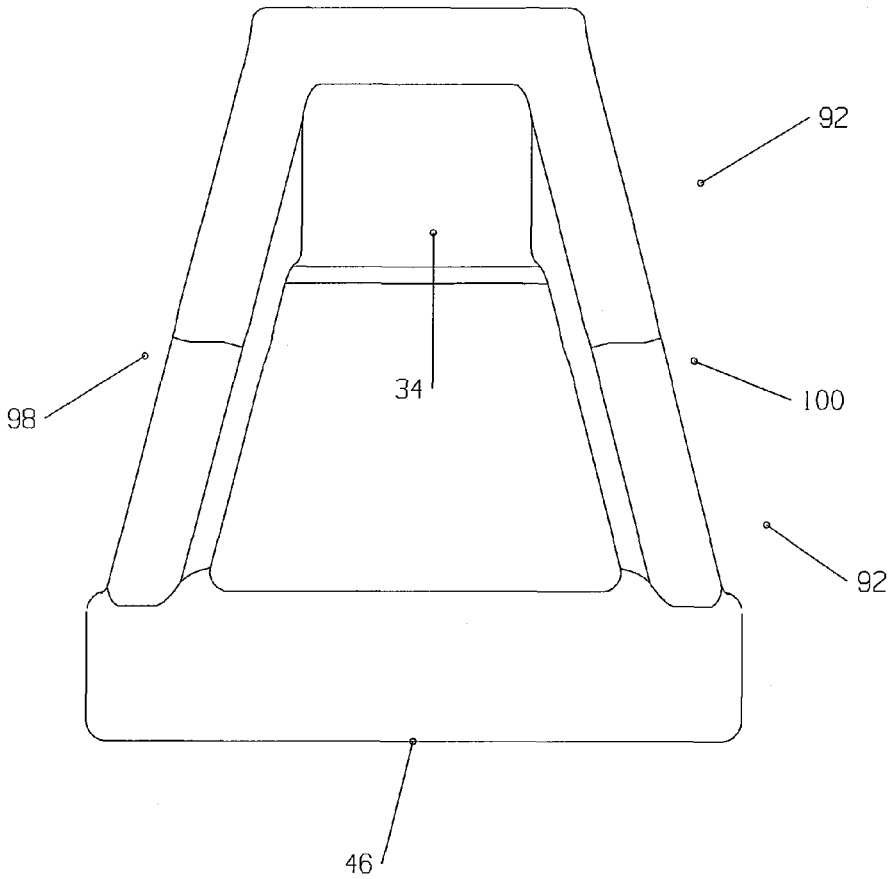

With the embodiments illustrated in FIGS. 10A-10E and 11A-11D, angled handle 92 is seen to have an angled yoke 96, angled with respect to a vertical axis (see FIGS. 10B and 11B). Angled yoke 96 may include a first arm 98 and a second arm 100. First arm 98 is seen to include a first angled portion 98*a* and a second angled portion 98*b* with an elbow 98*c* therebetween. Second arm 100 is seen to comprise a first angled portion 100*a*, a second angled portion 100*b*, and an elbow portion 100*c* therebetween. In a side view, first angled portions 98*a*/100*a* make substantially the same angle α with respect to the vertical axis. It is clear from the Figures that angled portions 98*b*/100*b* are substantially perpendicular to the vertical axis, substantially parallel to the horizontal axis, the vertical axis being the axis of the body and the axis through which the fluid leaving nozzle 20 takes under the impetus of gravity.

Angle α may be in the range of 30 to 60 (nominally)45°, but whatever the range, it will be seen that the angle β of second angled portion 98*b*/100*b* is approximately perpendicular to the vertical axis, parallel to the horizontal axis. Cross-member 46 forms an axis coming out of the page as seen, for example, in FIG. 10B. Such a configuration allows a user to grasp cross-member 46 and move it upward or downward as seen in FIG. 10B, to operate or open the valve and provide dispensing of a fluid therefrom. That is to say, FIG. 10B illustrates the handle configured in an off position and movement either up or down in the direction of the arrows will provide an opening of the valve for the dispensing of fluid therefrom.

FIGS. 10A and 10B illustrate that Applicants' second depending handle 16 may be used with angled handle 62. As base 34 is configured the same as in the first embodiment so too will the elements of second, depending handle 16.

FIG. 10C illustrates that Applicants' beverage dispensing valve 10 may use Applicants' novel angled handle 92 without a second depending handle 16. That is to say, in the restricted sense, this is no longer a multi-handle beverage dispensing valve 10, but is a dispensing valve 10 with a single handle 92 (or the single handle 14 of FIGS. 1-4) with the angled yoke 96 as set forth in FIGS. 10A and 10B. With or without depending handle 16, angled handle 92 is seen to displace cross-member 46, both lower than first upstanding handle 14 and closer to an operator, when the operator is standing typically in front of the dispensing machine. In a preferred embodiment, angled/downturned handles are on a dispensing machine and a support surface, and the entire setup places cross-members less than about 48" above a floor (see FIG. 13A). Typically, the near end of handle 16 will be less than about 48" off a support surface. FIG. 10E illustrates a perspective view of the angled handle and valve engaging an urn 72 having a base 74, which may include a drip tray 76.

Figures 13A, 13B:
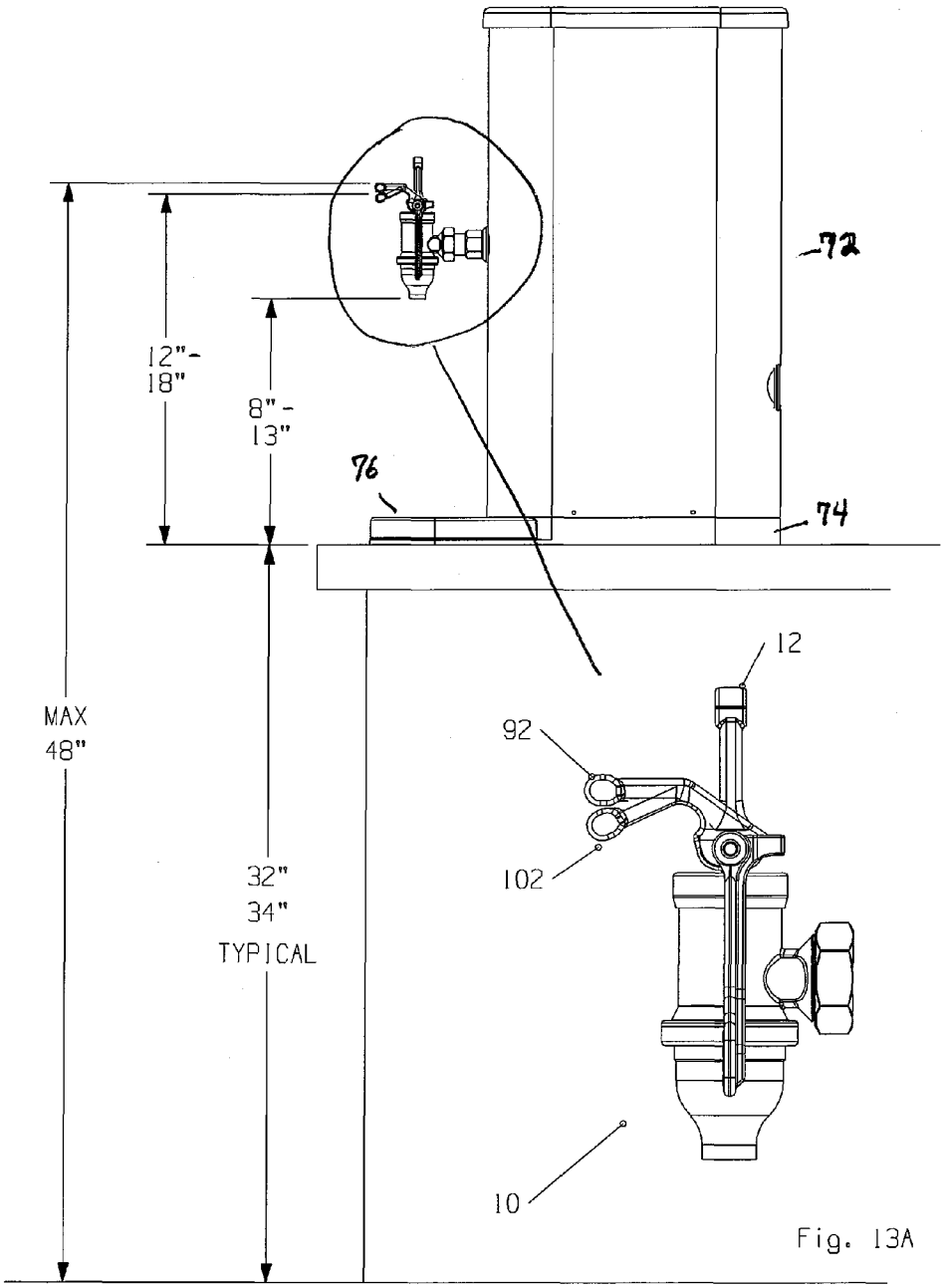
FIGS. 13A and 13B illustrate dimensions of Applicants' handles with respect to a countertop and a support surface.

It is noted that in all these embodiments, there is a vertical axis Va to the valve body. The vertical axis runs through the center of the nozzle and vertically up perpendicular to the lateral member 22. The distance between the removed end of either first handle as projected to the vertical axis and the removed end of the depending handle will have a vertical distance Vd between them, which may be in the range of about 4 to 7 inches (see FIG. 10B). The distance between the bottom wall of urn 72 and the removed end of the first angled handle may be in the range of about 12 to 18 inches (FIGS. 10E and 13A). VL is usually a few inches less than Vu. It is believed such ranges will cover the ADA Act (Americans With Disabilities) as it applies to dispensing machines. The placement of the valve body may be in the range of about 8 to 13 inches from the urn bottom to the near end of the nozzle (see FIGS. 13A and 13B).

Figure 12A:
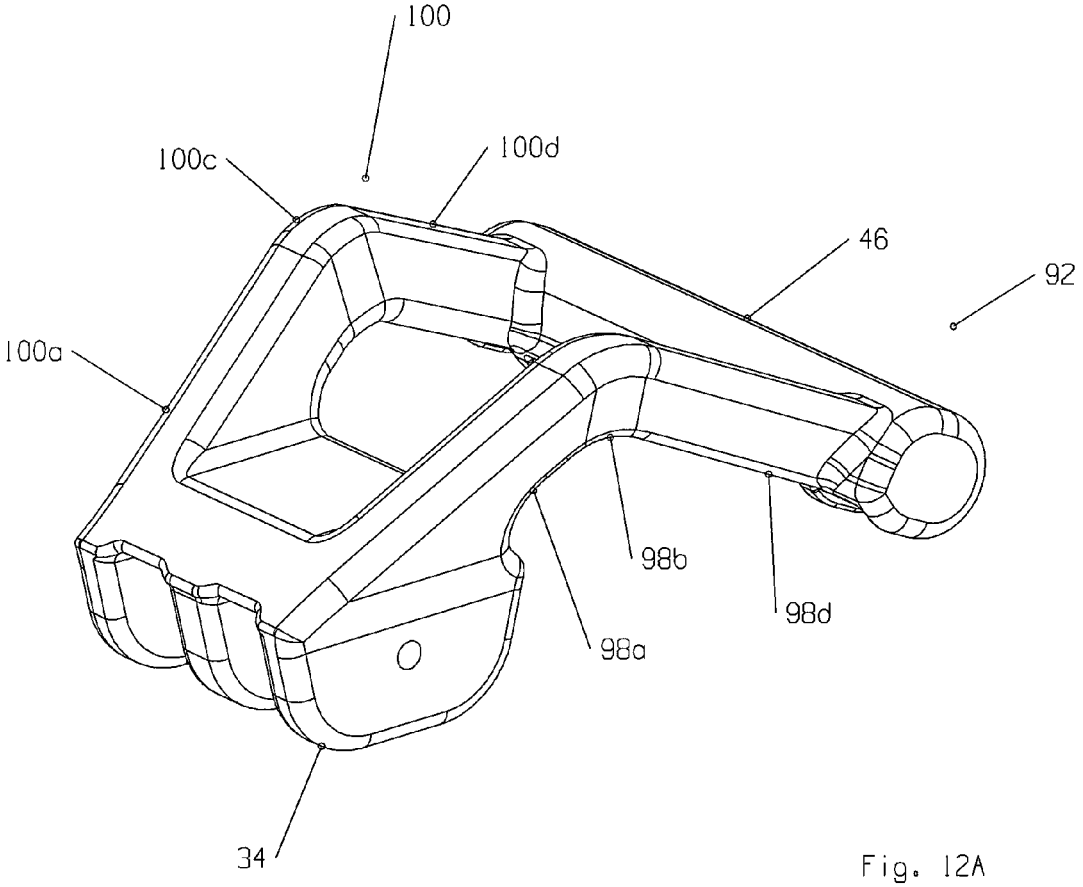
FIGS. 12A, 12B, 12C, and 12D illustrate perspective, right-side elevational bottom and top views, respectively, of a downturned embodiment of Applicants' first handle, which may be used with or without Applicants' depending handle.
Figure 12B:
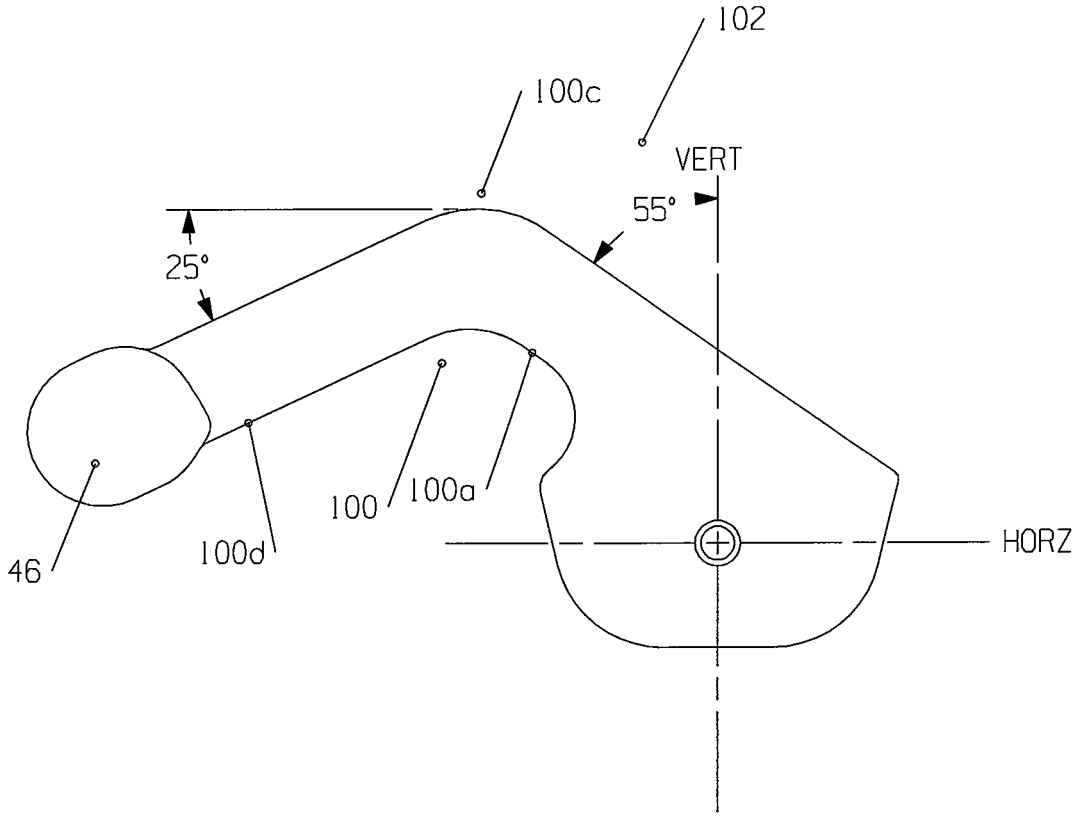
Figure 12C:
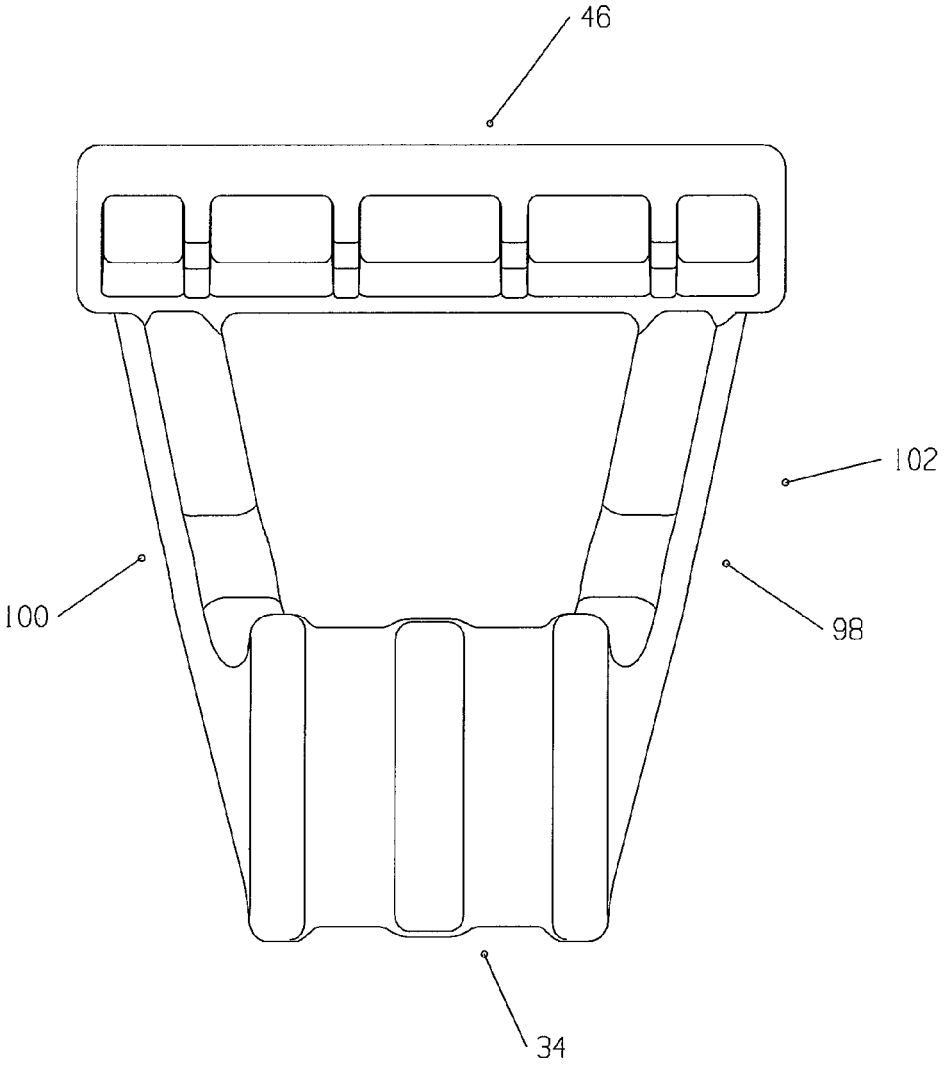
Figure 12D:
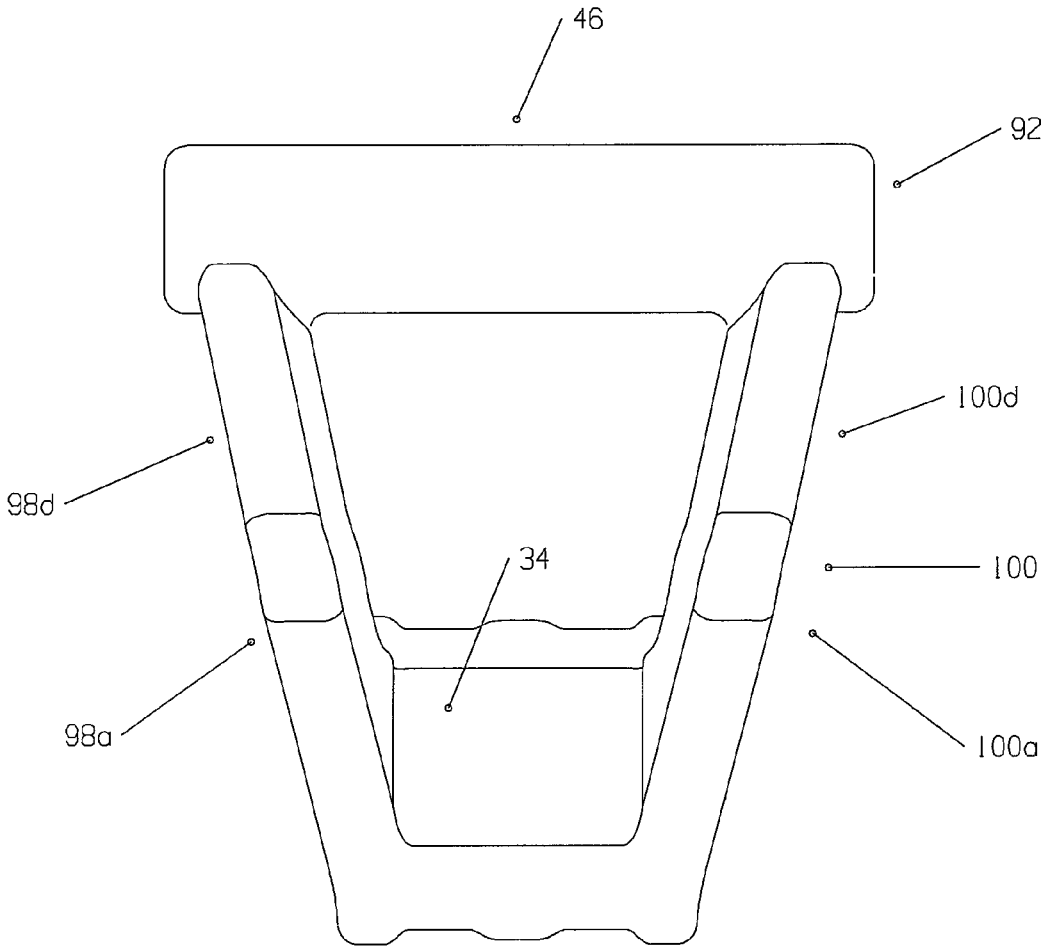
Figure 12E:
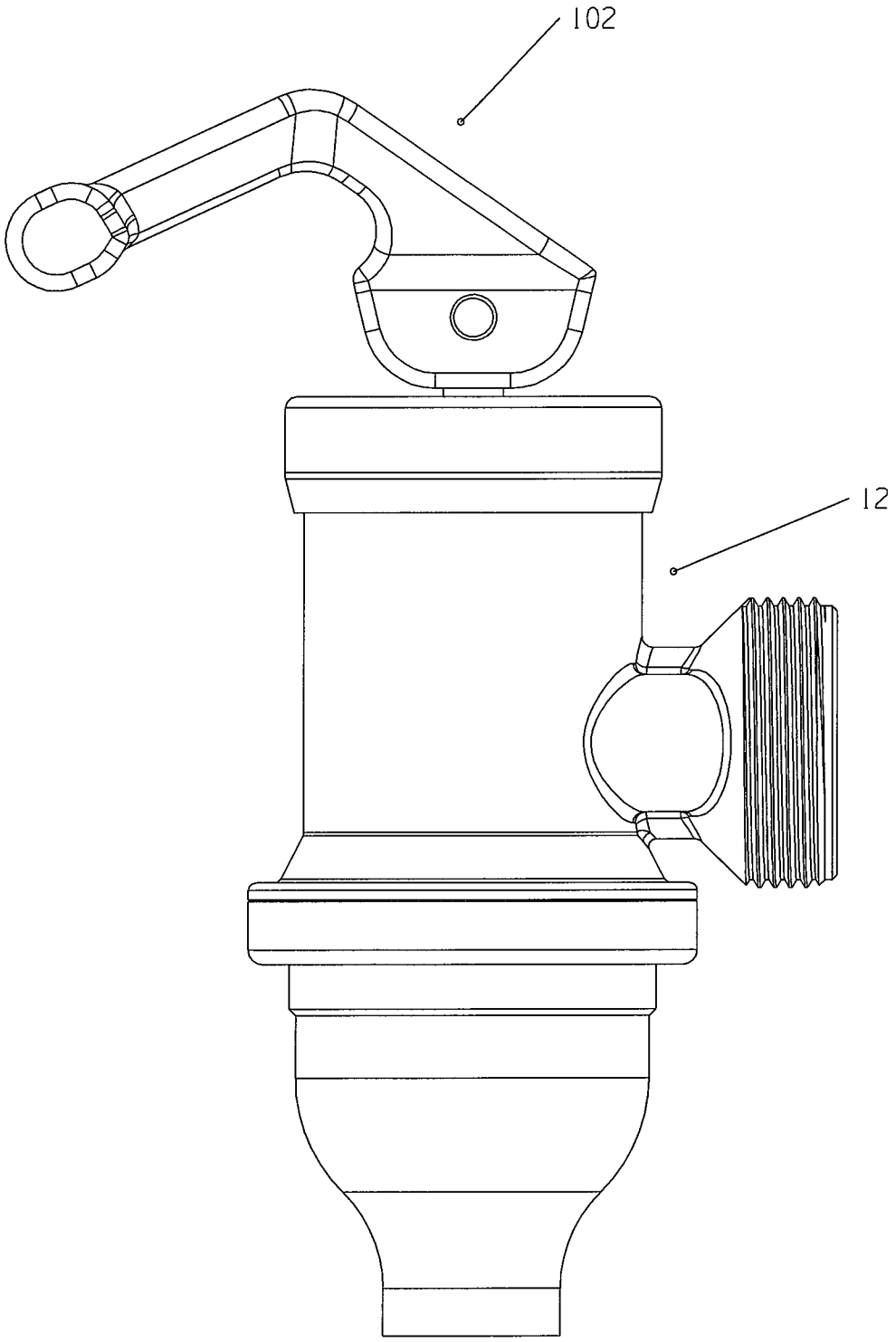
FIGS. 12E and 12F illustrate side and perspective views of the downturned embodiment of Applicants' first handle engaged with a valve without a second, depending handle.
Figure 12F:
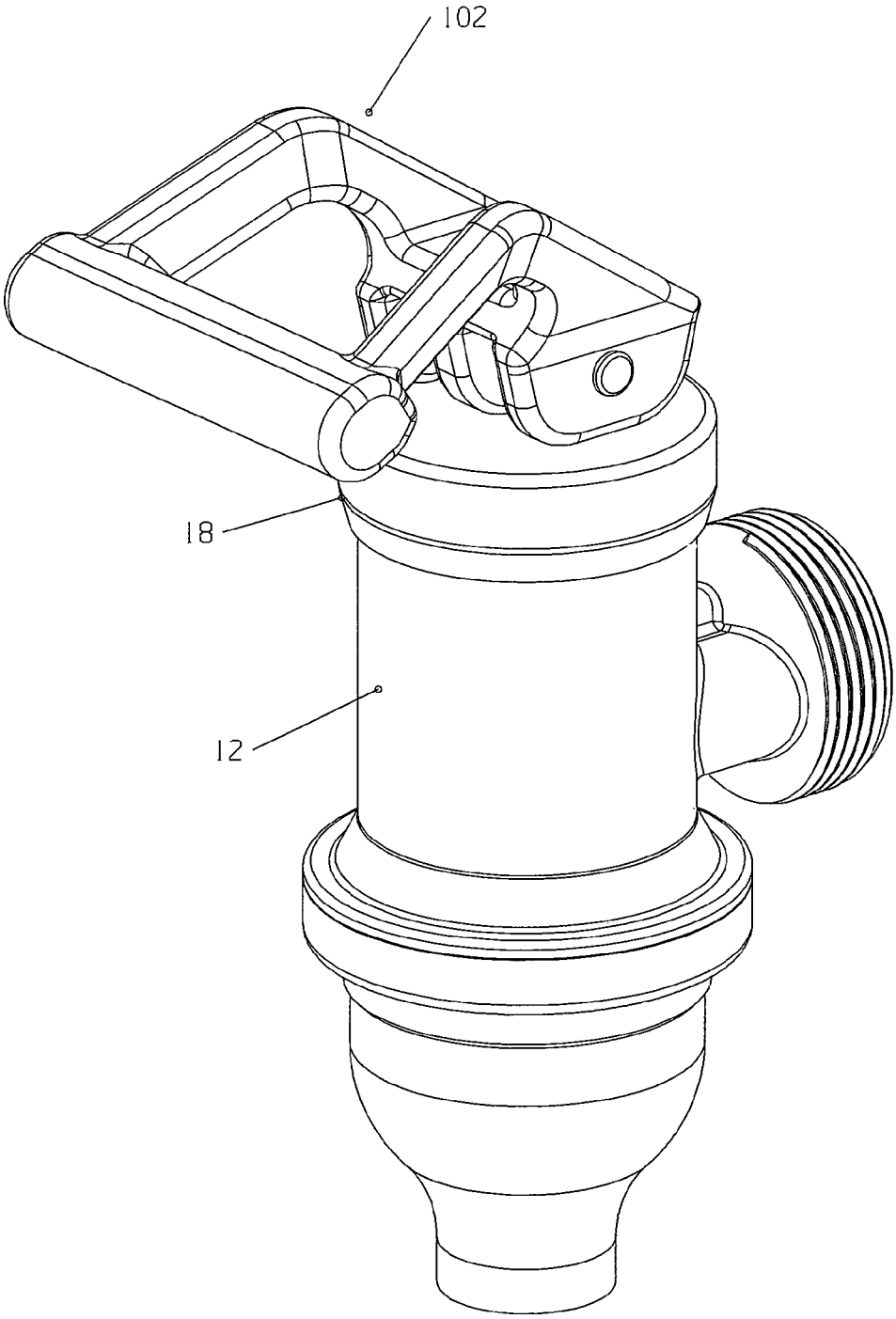

FIGS. 12A and 12F illustrate a third embodiment 102 of the handle, which is a variation of the angled yoke 92. However, the angle at first angle portion makes may be the same or greater than first angle portion of handle 92. Furthermore, second angle portion 100*b* is usually greater than 90° with respect to Va. In one embodiment, it is 115°. This places cross-member 46 even lower than the cross-member of angle handle 92.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A beverage dispensing device, comprising:

a beverage dispensing valve having a multiplicity of linearly moving vertically aligned activation members, a valve body, a valve top at a near end of the body, a nozzle at a removed end of the valve body, the valve body having a vertical axis;

a first handle member having a removed end and engaging the activation members and extending at least partly upward from the valve top; and a second depending handle member having a removed end and a base adjacent the valve top, the second depending handle member depending downward from the top of the valve body, and lay adjacent and to a side of the vertical axis of the valve body, and trend substantially parallel to the vertical axis when in a first, non-dispensing position;

the first handle member and the second depending handle member configured such that moving either handle member from a first, non-dispensing position to a second, dispensing position activates the activation members and initiate a flow of a beverage from the nozzle of the valve body;

wherein the activation members extend upward from the valve top and further include a pin for engaging the removed end thereof to the first handle member and the second depending handle member.

2. The beverage dispensing device of claim 1, wherein the first handle member and the second depending handle member have walls configured such that pivoting the removed end of the second depending handle member in a first direction will cause the first handle member to rotationally pivot in a second direction so as to initiate the flow of the beverage from the nozzle of the valve body.

3. The beverage dispensing device of claim 1, further including the pin entrained on the removed end of the activation members, wherein the first handle member includes a yoke and a base and the second depending handle member includes a handle body, wherein the base of at least one of the first handle member and the second depending handle member is configured to engage the pin entrained upon the removed end of the activation members such that pivoting the yoke of the first handle member will raise the activation members, but pivoting the second depending handle member will cause the yoke to pivot and the activation members to thereby raise.

4. The beverage dispensing device of claim 1, wherein the second depending handle member includes an elongated arm body, and a tabular end portion.

5. The beverage dispensing device of claim 4, wherein the second depending handle member is configured such that the elongated arm body and the tabular end portion lay adjacent and to the side of the vertical axis of the valve body.

6. The beverage dispensing device of claim 5, wherein the tabular end portion has a width greater than a width of the elongated arm body.

7. The beverage dispensing device of claim 1, wherein the valve body includes a lateral member configured to engage the valve body substantially perpendicular thereto between the valve top and the nozzle.

8. The beverage dispensing device of claim 1, wherein the vertical distance between the removed end of the first handle member and the second depending handle members is in a range of about 4 to about 7 inches.

9. The beverage dispensing device of claim 1, wherein the first handle member and the second depending handle member are integral.

10. The beverage dispenser of claim 1, wherein the first handle member is yoke-shaped and has a near portion and a removed portion, the removed portion making an angle of about 90° with respect to a vertical axis of the dispensing valve when the first handle member is in a first non-dispensing position.

11. The beverage dispenser of claim 1, wherein the first handle member is yoke-shaped and has a near portion and a removed portion, the near and the removed portion making an angle of about 0° with respect to a vertical axis of the dispensing valve when the first handle member is in a first non-dispensing position.

12. The beverage dispenser of claim 1, wherein the first handle member is yoke-shaped and has a near portion and a removed portion, the removed portion making an angle of greater than about 90° with respect to a vertical axis of the dispensing valve when the first handle member is in a first non-dispensing position.

13. A beverage dispenser comprising:

an urn having urn side walls, a top, and a bottom adapted to rest on a support surface;

a beverage dispensing valve having a multiplicity of linearly moveable, vertically aligned activation members, a valve body, a valve top at a near end of the body, a nozzle at a removed end of the valve body, the valve body having a vertical axis;

a first handle member having a removed end and engaging the activation members and extending at least partly upward from the valve top; and a second depending handle member having a removed end and a base adjacent the valve top, the second depending handle member depending downward from the top of the valve body, and lay adjacent and to a side of the vertical axis of the valve body, and trend substantially parallel to the vertical axis when in a first, non-dispensing position;

the first handle member and the second depending handle member configured such that moving either first handle member the second depending handle member from a first, non-dispensing position to a second, dispensing position activates the activation members and initiate a flow of a beverage from the nozzle of the valve body;

wherein the activation members extend upward from the valve top and further include a pin engaging the removed end thereof to the first handle member and the second depending handle member.

14. The beverage dispenser of claim 13, wherein the vertical distance between the removed end of the first handle member and the bottom of the urn is in a range of about 13 to 19 inches.

15. The beverage dispenser of claim 13, wherein the vertical distance between the removed end of the second handle member and the bottom of the urn is in a range of about 9 to 14 inches.

16. The beverage dispenser of claim 13, wherein the vertical distance between the removed end of the first handle member and the bottom of the urn is in a range of about 13 to 19 inches; and wherein the vertical distance between the removed end of the second handle member and the bottom of the urn is in a range of about 9 to 14 inches.

17. The beverage dispenser of claim 16, wherein the first handle member and the second depending handle member have walls configured such that pivoting the removed end of the second depending handle member in a first direction will cause the first handle member to pivot so as to initiate the flow of the beverage from the nozzle of the valve body.

18. The beverage dispenser of claim 1, wherein the first handle member and the second depending handle member are integral.

19. In a beverage dispensing valve having a multiplicity of linearly moveable, vertically aligned activation members, a valve body, a valve top at a near end of the body, a nozzle at a removed end of the valve body, the valve body having a vertical axis, providing a retrofittable modification comprising:

a first handle member having a removed end and engaging the activation members and extending at least partly upward from the valve top; and a second depending handle member having a removed end and a base adjacent the valve top, the second depending handle member depending downward from the top of the valve body, and lay adjacent and to a side of the vertical axis of the valve body, and trend substantially parallel to the vertical axis when in a first, non-dispensing position;

wherein the first handle member and the second depending handle member configured such that moving either first handle member the second depending handle member from a first, non-dispensing position to a second, dispensing position activates the activation members and initiate a flow of a beverage from the nozzle of the valve body; and wherein the activation members extend upward from the valve top and further include a pin engaging the removed end thereof to the first handle member and the second depending handle member.

20. The beverage dispensing valve of claim 19, wherein the first handle member and the second depending handle member are integral.

21. The beverage dispensing devices of claim 19, wherein the distance between the removed end of the first handle member and the second depending handle member is about 4" to 7".

* * * * *